US008684491B2

(12) United States Patent
Takagi et al.

(10) Patent No.: US 8,684,491 B2
(45) Date of Patent: Apr. 1, 2014

(54) IMAGE FORMING APPARATUS, IMAGE CORRECTING METHOD, AND COMPUTER-READABLE STORAGE MEDIUM

(75) Inventors: Yasunobu Takagi, Kanagawa (JP); Toshihito Kamei, Tokyo (JP); Takashi Kimura, Kanagawa (JP); Taku Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 195 days.

(21) Appl. No.: 13/409,504

(22) Filed: Mar. 1, 2012

(65) Prior Publication Data

US 2012/0223989 A1 Sep. 6, 2012

(30) Foreign Application Priority Data

Mar. 2, 2011 (JP) ..... 2011-045203

(51) Int. Cl.
*B41J 29/393* (2006.01)

(52) U.S. Cl.
USPC ..... 347/19

(58) Field of Classification Search
CPC ..... B41J 2/2132; B41J 2/2135; B41J 19/142; B41J 19/145
USPC ..... 347/12, 14, 19, 20, 40, 15, 41
See application file for complete search history.

(56) References Cited

U.S. PATENT DOCUMENTS

| | | | | |
|---|---|---|---|---|
| 5,009,463 | A | 4/1991 | Saitoh et al. | |
| 5,545,277 | A | 8/1996 | Hashemi et al. | |
| 6,432,522 | B1 | 8/2002 | Friedman et al. | |
| 7,717,534 | B2 * | 5/2010 | Inaba et al. | 347/19 |
| 2006/0032181 | A1 | 2/2006 | Recker | |
| 2007/0139460 | A1 * | 6/2007 | Araki | 347/19 |
| 2008/0176043 | A1 | 7/2008 | Masaki et al. | |

(Continued)

FOREIGN PATENT DOCUMENTS

| | | |
|---|---|---|
| EP | 908866 | 7/2005 |
| JP | 2000142119 | 5/2000 |
| JP | 2005-219286 B2 | 8/2005 |
| JP | 2006-224419 A | 8/2006 |

OTHER PUBLICATIONS

Using Plastics in Auto "Glass" Can Lightweight a Vehicle and Help Prevent Passenger Injuries, American Chemistry Council, http://www.google.com/url?sa=t&rct=j&q=&esrc=s&source=web&cd=1&ved=0CGoQFjAA&url=http%3A%2F%2Fwww.plastics-car.com%2Fautoglass&ei=pFSzT_reOcvjrAeR_LXLBg&usg=AFQjCNF7FyN2LzCCqL0CV2iv7VVyFbTuvg&sig2=VSJYjMuPDgx1Ug364KEcpg.

(Continued)

*Primary Examiner* — Julian Huffman
*Assistant Examiner* — Sharon A Polk
(74) *Attorney, Agent, or Firm* — Harness, Dickey & Pierce, P.L.C.

(57) ABSTRACT

An image forming apparatus includes a recording head including a plurality of nozzles for ejecting recording liquid to perform image formation on a recording medium; and a correcting unit. The correcting unit is configured to divide the recording head by different division patterns each indicating that the recording head is divided into a plurality of segments by at least one different dividing point, correct input and output characteristics for each of the segments in each division pattern to calculate correction effect of the each division pattern, and determine one of the division patterns based on the calculated correction effects of the division patterns as a specified division pattern to correct input and output characteristics of the recording head.

14 Claims, 23 Drawing Sheets

(56) References Cited

U.S. PATENT DOCUMENTS

| | | | |
|---|---|---|---|
| 2009/0179934 | A1 | 7/2009 | Takagi et al. |
| 2010/0182366 | A1 | 7/2010 | Takagi et al. |
| 2010/0182367 | A1 | 7/2010 | Takagi et al. |

OTHER PUBLICATIONS

Jun Lu, Acoustic Windshield Significantly Reduces Structure-Bourne and Airbourne Noises for Deisel Vehicles and Brings Ecological Benifit, Society of Automotive Engineers, 09NVC-0331, 2008, http://www.google.co.in/url?sa=t&rct=j&q=&esrc=s&source=web&cd=1&ved=0CF4QFjAA&url=http%3A%2F%2Fwww.saflex.com%2Fpdf%2FSaflex%25C2%25AE%2520Technical%2520Paper%2520-%2520Acoustic%2520Windshields%2520and%2520Environmental%2520Benefit.

Gur et al., Lightweight Glazing Materials and their NVH Performance in Vehicle Design, Ford Research and Advanced Engineering Technical Reports, SRR-2011-0097, Aug. 5, 2011.

Abstract of JP 2006-224419 published Aug. 31, 2006.

Abstract of JP 2005-219286 published Aug. 18, 2005.

* cited by examiner

NO CORRECTION
BRIGHTNESS
POSITION
7

DIVIDE INTO TWO AND CORRECT
BRIGHTNESS
POSITION
7

DIVIDE INTO THREE AND CORRECT
BRIGHTNESS
POSITION
7

DIVIDE INTO FOUR AND CORRECT
BRIGHTNESS
POSITION
7

DIVIDE INTO FIVE AND CORRECT
BRIGHTNESS
POSITION
7

(a)

(b)

IMAGE FORMING APPARATUS, IMAGE CORRECTING METHOD, AND COMPUTER-READABLE STORAGE MEDIUM

CROSS-REFERENCE TO RELATED APPLICATIONS

The present application claims priority to and incorporates by reference the entire contents of Japanese Patent Application No. 2011-045203 filed in Japan on Mar. 2, 2011.

BACKGROUND OF THE INVENTION

1. Field of the Invention

The present invention relates to an image forming apparatus, an image correcting method, and a computer-readable storage medium.

2. Description of the Related Art

As image forming apparatuses such as a printer (a printing apparatus), a facsimile, a copying apparatus, and a complex machine of these apparatuses, for example, there is an image forming apparatus of a so-called inkjet system that performs, using a device including a recording head (hereinafter also referred to as "head") including a liquid ejection head for ejecting droplets of recording liquid (hereinafter also referred to as "ink"), image formation (recording, printing, and imaging are also used as synonyms) by depositing, while conveying a recording medium (hereinafter also referred to as "sheet", however, this does not limit a material; recording medium, medium, transfer material, recording paper, and the like are used as synonyms), the recording liquid serving as liquid on the sheet.

The image forming apparatus of the inkjet system has advantages that, for example, high-speed recording is possible, recording can be performed on so-called plain paper without requiring special fixing processing, and operation sound during the recording is extremely small. Therefore, the image forming apparatus attracts attention as an image forming apparatus for offices. Various types are proposed and put to practical use in the past.

Image formation by the inkjet system is realized by applying, using a recording head in which an ink liquid chamber and nozzles communicating with the ink liquid chamber are formed, pressure to ink in the ink liquid chamber according to image information to thereby eject ink droplets from the nozzles and deposit the ink droplets on a recording medium such as paper or a film. Because the image formation is performed in a non-contact manner, there is a characteristic that recording can be performed on various recording media.

As a problem of the image forming apparatus of the inkjet system, a problem concerning unevenness of print (hereinafter also referred to as "print unevenness", "color unevenness", and "unevenness") is known. Various causes are known as a cause of the print unevenness. In particular, fluctuation in ink ejection characteristics of an inkjet head is known as a problem.

The inkjet head includes a plurality of nozzles and applies pressure to a liquid chamber communicating with the nozzles to eject ink. However, it is inevitable that slight fluctuation could occur concerning the performances of the respective nozzles. Therefore, ejection characteristics of the ink are not always the same. The "ejection characteristics (also simply referred to as "characteristics") mean the size, the speed, the arriving position, and the shape of ink droplets. Because a way of covering of the ink on a recording sheet changes according to the ejection characteristics, print unevenness is caused.

In recent years, image forming apparatuses are requested to be increased in speed and improved in image quality. To satisfy this request, the number of nozzles per one head an increase in the length of the head and nozzle formation density) tends to further increase. If the number of nozzles and the nozzle formation density increase, the number of defective nozzles also increases according to the increase in the number of nozzles and the nozzle formation density. Therefore, the problem of the fluctuation in the ejection characteristics is more important.

Concerning the problem, for example, Japanese Patent Application Laid-open No. 2006-224419 discloses a printing apparatus that corrects an input and an output for each of nozzles (corrects the number of dots to be ejected) to thereby correct characteristics of a head for the purpose of reducing banding phenomenon due to density unevenness (a phenomenon in which a dot arriving position in a connecting portion of scanning deviates and a streak-like image failure occurs because of various factors such as a sheet feeding error and backlash of the head).

However, as explained above, the number of nozzles of the inkjet head tends to increase according to the increase in the length and the density of the head. An image forming apparatus mounted with a large number of heads for improvement of a color gamut, an increase in speed, improvement of resolution, and the like is also developed. Therefore, an enormous number of nozzles have to be managed.

Further, for example, near solid, because a paper surface is almost filled with ink from the beginning, a tint less easily changes even if a dot diameter slightly changes. However, in highlight to middle (the middle of sold and highlight), because the paper surface is not fully filled with the ink, the ting easily changes. Specifically, even if nozzles are the same, in some case, a correction coefficient (a correction parameter or a correction amount of a color) is different depending on a gradation and correction cannot be performed with a uniform coefficient. In particular, in a multi-value inkjet printer that handles a plurality of droplet types (large droplets, medium droplets, small droplets, etc.), when characteristics are different depending on a droplet type, in some case, even if the medium droplets are the same, the size of the large droplets is different. Therefore, this problem becomes conspicuous.

When all the above problems are taken into account, it is necessary to prepare correction parameters by a number calculated from "the number of heads (when an image forming apparatus includes a plurality of heads)×the number of nozzles×the number of gradations" and apply the correction parameters. For example, if an image printing result is measured to create the correction parameters, it is necessary to output and measure images equivalent to "the number of heads×the number of nozzles×the number of gradations" and create the correction parameters. If such control is performed, a configuration for acquiring ejection characteristics of all nozzles and a configuration for storing and applying a large number of parameters are necessary. This leads to an increase in cost of a product, a decrease in processing speed, and the like.

To solve this problem, it is conceivable to expand a unit for correction (a correction unit), i.e., grasp a plurality of nozzles as one unit (segment), collectively apply correction parameters for each nozzle segment, and perform correction.

This makes it possible to substantially reduce measurement points for parameter generation and the number of correction parameters. However, if the correction unit is simply expanded, a correction effect decreases. For example, it is likely that a gap (a difference) in a color change occurs in a boundary of correction segments and a change of a print pattern is conspicuous. As a result, print unevenness cannot be sufficiently solved.

Therefore, there is a need for an image forming apparatus, an image correcting method, and a computer-readable storage medium that can obtain a satisfactory correction effect by dividing, in correction processing for dividing an area to be corrected into several correction segments and performing correction for a reduction in print unevenness, the area to obtain an optimum color unevenness correction effect.

SUMMARY OF THE INVENTION

It is an object of the present invention to at least partially solve the problems in the conventional technology.

According to an embodiment, there is provided an image forming apparatus that includes a recording head including a plurality of nozzles for ejecting recording liquid to perform image formation on a recording medium; and a correcting unit configured to divide the recording head by different division patterns each indicating that the recording head is divided into a plurality of segments by at least one different dividing point, correct input and output characteristics for each of the segments in each division pattern to calculate correction effect of the each division pattern, and determine one of the division patterns based on the calculated correction effects of the division patterns as a specified division pattern to correct input and output characteristics of the recording head.

According to another embodiment, there is provided an image correcting method that includes dividing a recording head by different di vision patterns each indicating that the recording head is divided into a plurality of segments by at least one different dividing point, the recording head including a plurality of nozzles for ejecting recording liquid to perform image formation on a recording medium; correcting input and output characteristics for each of the segments in each division pattern to calculate correction effect of the each division pattern; and determining one of the division patterns based on the calculated correction effects of the division patterns as a specified division pattern to correct input and output characteristics of the recording head.

According to still another embodiment, there is provided a non-transitory computer-readable storage medium with an executable program stored thereon. The program instructs a processor of the image forming apparatus to perform the image correcting method according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Configurations according to the present invention are explained in detail below based on embodiments shown in FIGS. 1 to 30.

First Embodiment

Configuration of an Image Forming Apparatus

Figure 1:
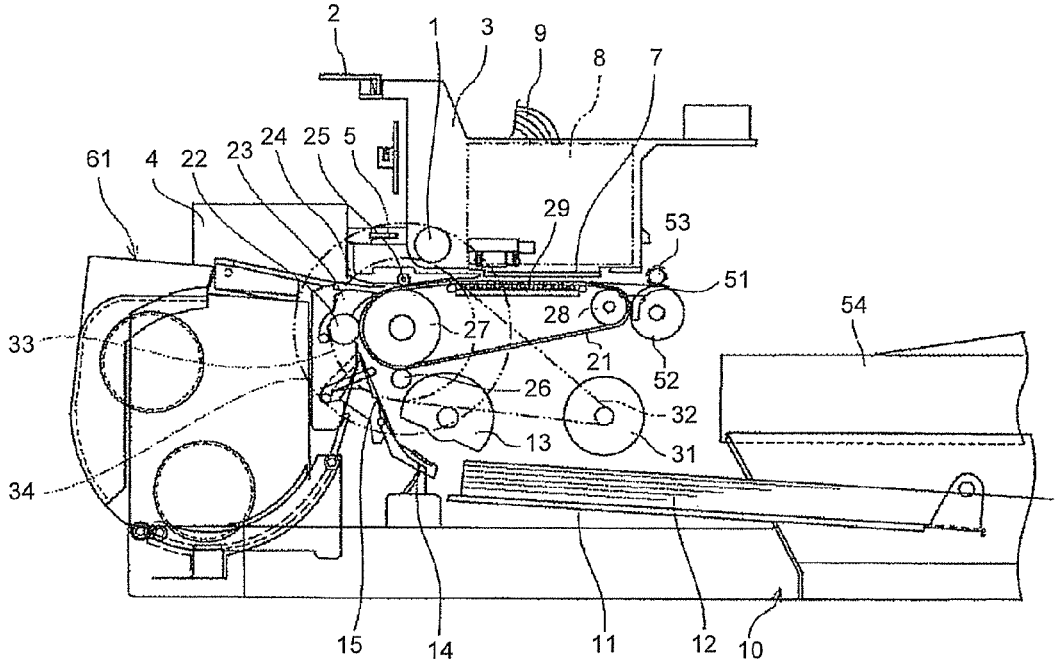
FIG. 1 is a side view of an example of the configuration in an embodiment of an image forming apparatus according to the present invention.
Figure 2:
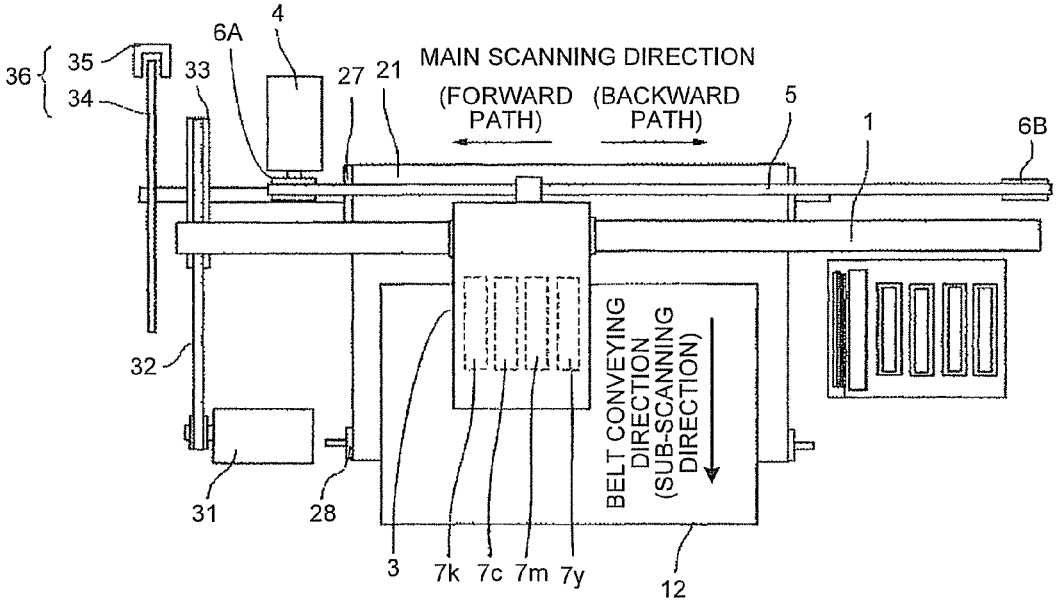
FIG. 2 is a plan view of an example of the configuration of the image forming apparatus.

FIGS. 1 and 2 are diagrams of an image forming apparatus according to a first embodiment. FIG. 1 is a side view for explaining the overall configuration of a mechanical unit and FIG. 2 is a plan view for explaining the mechanical unit.

In the image forming apparatus, a carriage 3 is held slidably in a main scanning direction by a guide rod 1 and a guide rail 2, which are guide members laid and suspended between not-shown left and right side plates. Recording head scanning means is moved by a main scanning motor 4 in the arrow direction (the main scanning direction) in FIG. 2 via a timing belt 5 stretched and suspended between a driving pulley 6A and a driven pulley 6B and performs scanning. In the carriage 3, for example, our recording heads 7*y*, 7*c*, 7*m*, and 7*k* (when the colors are not distinguished, each is referred to as "recording head 7") including liquid ejection heads, which respectively elect ink droplets of yellow (Y), cyan (C), magenta (M), and black (K), are mounted in a state in which a plurality of ink ejection ports are arrayed in a direction crossing the main scanning direction and an ink droplet ejection direction is faced downward. In the carriage 3, sub-tanks 8 for the colors for supplying inks of the colors to the recording heads 7 are mounted. The inks are supplied to the sub-tanks 8 from not-shown main tanks (ink cartridges) via an ink supply tube 9.

As a liquid ejection head included in the recording head 7, for example, a liquid ejection head can be used that includes, as pressure generating means for generating pressure for ejecting droplets, a piezoelectric actuator such as a piezoelectric element, a thermal actuator that makes use of a phase change due to film boiling of liquid using an electro-thermal conversion element such as a heat element, a shape memory alloy actuator that makes use of a metal phase change due to a temperature change, or an electrostatic actuator that makes use of an electrostatic force. The recording head 7 is not limited to a head configuration independent for each of the colors. The recording head 7 can also include one or a plurality of liquid ejection heads including a nozzle row including a plurality of nozzles for electing droplets of a plurality of colors.

On the other hand, as a paper feeding unit for feeding sheets 12 stacked on a sheet stacking section (a pressure board) such as a paper feeding cassette 10, the image forming apparatus includes a semilunar roller (a paper feeding roller) 13, which separates and feeds the sheets 12 one by one from a sheet stacking unit 11, and a separation pad 14 opposed to the paper feeding roller 13 and made of a material having a large coefficient of friction. The separation pad 14 is urged to the paper feeding roller 13 side.

As conveying means for conveying the sheet 12, which is fed from the paper feeding section, on a lower side of the recording heads 7, the image forming apparatus includes a conveyor belt 21 for electrostatically attracting and conveying the sheet 12, a counter roller 22 for holding the sheet 12, which is fed from the paper feeding section via a guide 15, between the counter roller 22 and the conveyor belt 21 and conveying the sheet 12, a conveyance guide 23 for changing the direction of the sheet 12, which is fed substantially vertically upward, by about 90° and placing the sheet 12 along the conveyor belt 21, and a pressing roller 25 urged to the conveyor belt 21 side by a pressing member 24. The image forming apparatus includes a charging roller 26, which is charging means for charging the surface of the conveyor belt 21.

The conveyor belt 21 is an endless belt and is laid between a conveying roller 27 and a tension roller 28. When the conveying roller 27 is rotated by a sub-scanning motor 31 via a timing belt 32 and a timing roller 33, the conveyor belt 21 turns in a belt conveying direction (a sub-scanning direction) in FIG. 2. A guide member 29 is arranged on the rear surface side of the conveyor belt 21 to correspond to the image forming area by the recording heads 7. The charging roller 26 is arranged to be in contact with the surface layer of the conveyor belt 21 and rotate following the pivoting of the rotational movement of the conveyor belt 21.

As shown in FIG. 2, a slit disk 34 is attached to a shaft of the conveying roller 27. An encoder sensor 35 that detects a slit of the slit disk 34 is provided. The slit disk 34 and the encoder sensor 35 configure a rotary encoder 36.

As a paper discharge unit for discharging the sheet 12 on which an image is recorded by the recording heads 7, the image forming apparatus includes a separation claw 51 for separating the sheet 12 from the conveyor belt 21, a paper discharge roller 52 and a paper discharge roller 53, and a paper discharge tray 54 that stores the discharged sheet 12.

A duplex paper feeding unit 61 is detachably mounted on the back. The duplex paper feeding unit 61 captures the sheet 12 returned by opposite direction rotation of the conveyor belt 21, reverses the sheet 12, and feeds the sheet 12 to between the counter roller 22 and the conveyor belt 21 again.

Configuration of the Recording Head

Figure 3:
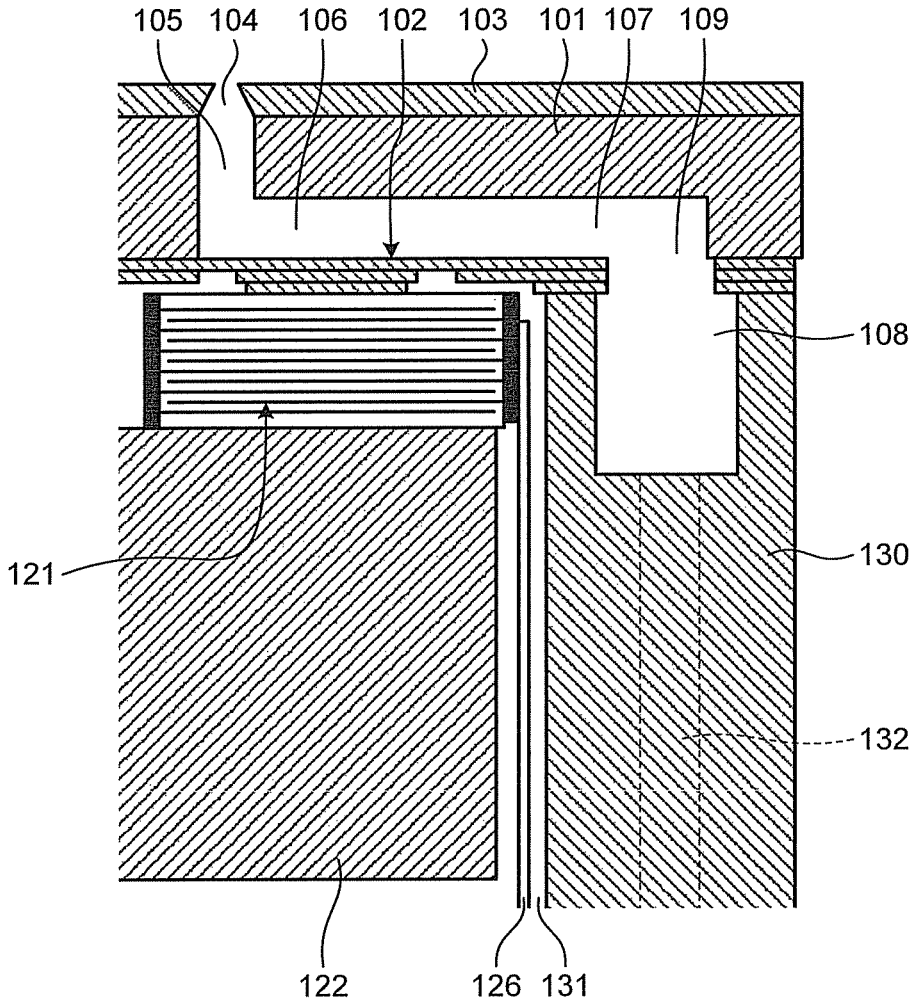
FIG. 3 is a sectional view (in a longitudinal direction of a liquid chamber) of an example of a recording head.
Figure 4:
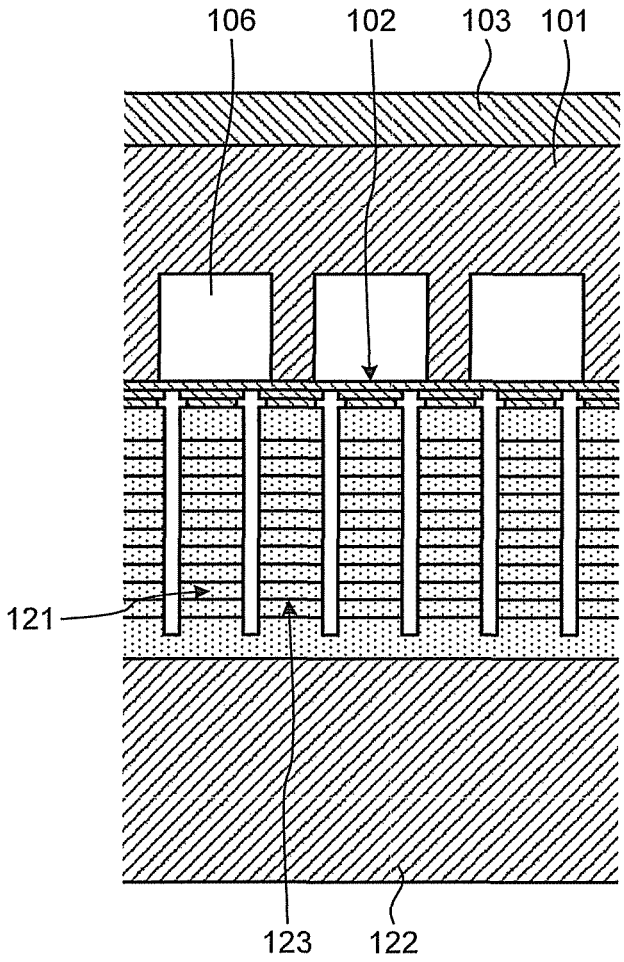
FIG. 4 is a sectional view (in a latitudinal direction of the liquid chamber) of the example of the recording head.

An example of the liquid ejection head included in the recording head 7 is explained with reference to FIGS. 3 and 4. FIG. 3 is a sectional view for explaining the example along a liquid chamber longitudinal direction of the head. FIG. 4 is a sectional view for explaining the example in a liquid chamber latitudinal direction (a nozzle arranging direction) of the head.

In the liquid ejection head, a channel plate 101 formed by subjecting, for example, a monocrystal silicon substrate to anisotropic etching, a vibrating plate 102 joined to the lower surface of the channel plate 101 and formed by, for example, nickel electroforming, and a nozzle plate 103 joined to the upper surface of the channel plate 101 are joined and laminated. A nozzle communicating path 105, which is a channel communicating with a nozzle 104 for ejecting droplets (ink droplets), and a liquid chamber 106, which is a pressure generating chamber, an ink supply port 109 that communicates with a common liquid chamber 108 for supplying ink to the liquid chamber 106 through a fluid resistance section (supply path) 107, and the like are formed by the channel plate 101, the vibrating plate 102, and the nozzle plate 103.

The liquid ejection head includes laminated piezoelectric elements 121 in two rows functioning as electromechanical conversion elements, which are pressure generating means (actuator means) for deforming the vibrating plate 102 and pressing the ink in the liquid chamber 106, and a base substrate 122 that loins and fixes the piezoelectric elements 121. A column portion 123 is provided between the piezoelectric elements 121. The column portion 123 is a part formed simultaneously with the piezoelectric elements 121 by dividing a piezoelectric element member. However, the column portion 123 is only a column because the column portion 123 does non apply a driving voltage.

Further, an FPC cable 126 mounted with a not-shown driving circuit (a driving IC) is connected to the piezoelectric elements 121.

A peripheral edge of the vibrating plate 102 is Mined to a frame member 130. In the frame member 130, a pierce through portion 131 that stores an actuator unit including the piezoelectric elements 121 and the base substrate 122, a recess functioning as the common liquid chamber 108, and an ink supply hole 132 for supplying the ink to the common liquid chamber 108 from the outside are formed in the frame member 130.

Configuration of a Control Unit

Figure 5:
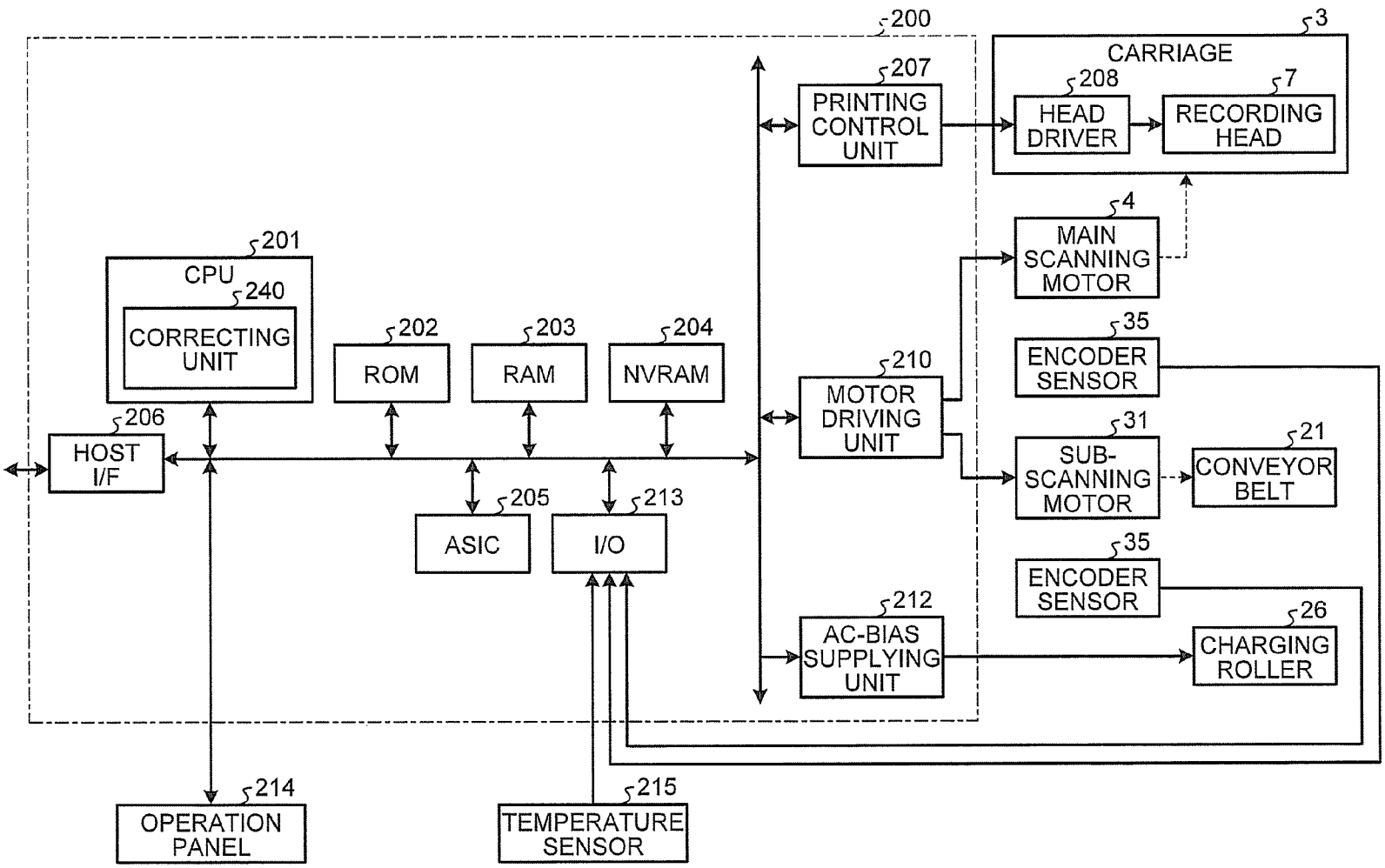
FIG. 5 is a schematic block diagram of a control unit.

An overview of a control unit functioning as control means of the image forming apparatus is explained with reference to a block diagram of FIG. 5. A control unit 200 includes a central processing unit (CPU) 201 that manages control of the entire apparatus, a read only memory (ROM) 202 having stored therein computer programs executed by the CPU 201 and other fixed data, a random access memory (RAM) 203 that temporarily stores image data and the like, a rewritable nonvolatile RAM (NVRAM) 204 for maintaining data even while a power supply for the apparatus is shut down, and an application specific integrated circuit (ASIC) 205 that performs various kinds of signal processing for image data, image processing for performing rearrangement and the like, and other processing of input and output signals for controlling the entire apparatus.

The control unit 200 includes a host interface (I/F) 206 for performing transmission and reception of data and signals with a host side, a printing control unit 207 including data transfer means for controlling to drive the recording heads 7 and driving-waveform generating means for generating a driving waveform, a head driver (a driver IC) 208 for driving the recording heads 7 provided on the carriage 3 side, a motor driving unit 210 for driving the main scanning motor 4 and the sub-scanning motor 31, an AC-bias supplying unit 212 that supplies an AC bias to the charging roller 26, and an input/output (I/O) 213 for inputting detection signals from the encoder sensor 35 and detection signals from various sensors such as a temperature sensor 215 that detects environmental temperature. An operation panel 214 for performing input and display of information necessary for the apparatus is connected to the control unit 200.

The control unit 200 receives, in the host I/F 206, image data and the like from a host side, for example, an image (information) processing apparatus such as a personal computer, an image reading apparatus such as an image scanner, or an image pickup apparatus such as a digital camera via a cable or a network.

The CPU 201 of the control unit 200 reads out and analyzes printing data in a reception buffer included in the host I/F 206, performs necessary image processing, data rearrangement processing, and the like in the ASIC 205, and transfers this image data from the printing control unit 207 to the head driver 208. Generation of dot pattern data for outputting an image can be performed by a printer driver on the host side as explained later.

The CPU 201 calculates a driving output value (a control value) to the main scanning motor 4 based on a speed detection value and a position detection value obtained by sampling a detection pulse from the encoder sensor 35 included in a linear encoder and a speed target value and a position target value obtained from speed and position profiles stored in advance. The CPU 201 drives the main scanning motor 4 via the motor driving unit 210. Similarly, the CPU 201 calculates a driving output value (a control value) to the sub-scanning motor 31 based on the speed detection value and the position detection value obtained by sampling the detection pulse from the encoder sensor 35 included in the rotary encoder 36 and the speed target value and the position target value obtained from the speed and position profiles stored in advance. The CPU 201 drives the sub-scanning motor 31 via the motor driving unit 210. As explained later, the CPU 201 functions as a correcting unit 240 in cooperation with the blocks of the image forming apparatus.

The printing control unit 207 transfers the image data to the head driver 208 as serial data and outputs a transfer clock, a latch signal, a droplet control signal (a mask signal), and the like necessary for transfer of the image data, decision of the transfer, and the like to the head driver 208.

The printing control unit 207 includes a driving-waveform generating unit including a D/A converter that D/A-converts pattern data of a driving signal stored in the ROM 202, a voltage amplifier, and a current amplifier and a driving-waveform selecting unit that selects a driving waveform given to the head driver 208. The printing control unit 207 generates a driving waveform including one driving pulse (driving signal) or a plurality of driving pulses (driving signals) and outputs the driving waveform to the head driver 208.

The head driver 208 drives the recording head 7 by applying the driving signal included in the driving waveform given from the printing control unit 207 based on image data equivalent to one row of the serially-input recording heads 7 to a driving element (e.g., as explained before, a piezoelectric element) that generates energy for selectively ejecting droplets of the recording heads 7. At this point, by selecting a driving pulse included in the driving waveform, for example, it is possible to properly shot dots having different sizes such as large droplets (large dots), medium droplets (medium dots), and small droplets (small dots).

Configuration of the Printing Control Unit and the Head Driver

Figure 6:
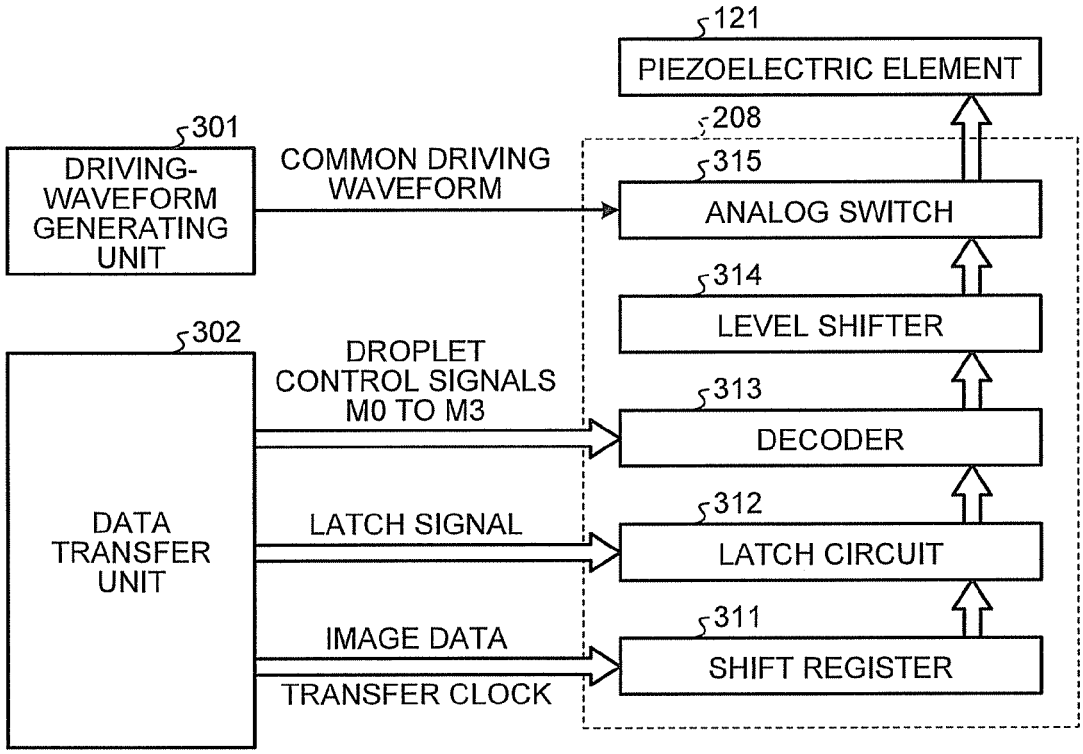
FIG. 6 is a block diagram of an example of a printing control unit.

An example of the printing control unit 207 and the head driver 208 is explained with reference to FIG. 6. As explained above, the printing control unit 207 includes a driving-waveform generating unit 301 that generates a driving waveform (a common driving waveform) including a plurality of driving pulses (driving signals) and outputs the driving waveform within one printing period and a data transfer unit 302 that outputs binary image data (gradation signals 0 and 1) corresponding to a printed image, a clock signal, a latch signal (LAT), and droplet control signals M0 to M3.

The droplet control signal is a binary signal for instructing, for each droplet, opening and closing of an analog switch 315, which is switch means, explained later of the head driver 208. The droplet control signal transitions a state to an H level (ON) in a waveform that should be selected according to a printing period of the common driving waveform. When no waveform, is selected, the droplet control signal transitions the state to an L level (OFF).

The head driver 208 includes a shift register 311 to which a transfer clock (a shift clock) and serial image data (gradation data: bit/CH) from the data transfer unit 302 are input, a latch circuit 312 for latching registration values of the shift register 311 with a latch signal, a decoder 313 that decodes the gradation signal and the droplet control signals M0 to M3 and outputs a result, a level shifter 314 that converts a logic level voltage signal of the decoder 313 into a level in which the analog switch 315 can operate, and the analog switch 315 that is turned on and off (opened and closed) according to an output of the decoder 313 given via the level shifter 314.

The analog switch 315 is connected to selection electrodes (individual electrodes) of the piezoelectric elements 121. The common driving waveform from the driving-waveform generating unit 301 is input to the analog switch 315. Therefore, the analog switch 315 is turned on according to a result obtained by decoding, with the decoder 313, the serially-transferred image data (the gradation data) and droplet control signals M0 to M3, whereby a required driving signal included in the common driving waveform passes (is selected) and is applied to the piezoelectric elements 121.

Configuration of an Image Forming System

Figure 7:
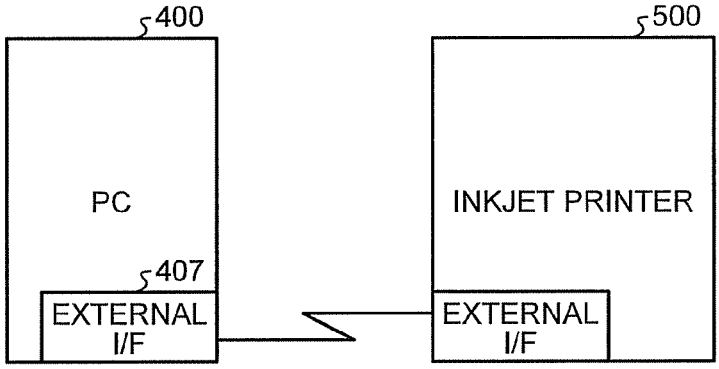
FIG. 7 is a block diagram for explaining an example of an image forming system configured by the image forming apparatus.

An embodiment of an image forming system that executes an image forming program stored in an image processing apparatus connected to the image forming apparatus and outputs a printed image using the image forming apparatus is explained with reference to FIG. 7. The image forming system is configured by connecting, through a predetermined interface or network, one or a plurality of image processing apparatuses 400 including personal computers (PCs) and an inkjet printer (an image forming apparatus) 500.

Figure 8:
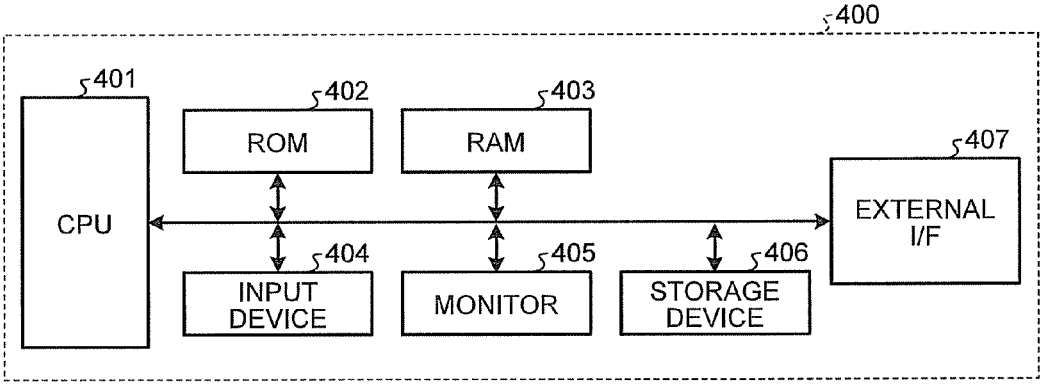
FIG. 8 is a block diagram for explaining an example of an image processing apparatus in the image forming system configured by the image forming apparatus.

In the image processing apparatus 400, as shown in FIG. 8, a CPU 401 and a ROM 402 and a RAM 403, which are memory means, are connected by a bus line. A storage device 406 including a magnetic storage device such as a hard disk, an input device 404 such as a mouse or a keyboard, a monitor 405 such as an LCD or a CRT, and a not-shown storage medium reading device that reads a storage medium such as an optical disk are connected to the bus line via a predetermined interface. Further, a network such as the Internet and a predetermined interface (external I/F) 407 that performs communication with an external device such as a USB are connected to the bus line.

An image processing program including an image correcting program according to the present invention is stored in the storage device 406 of the image processing apparatus 400. The image processing program is installed in the storage device 406 by, for example, being read from a storage medium by a storage medium reacting apparatus or being downloaded from a network such as the Internet. According to the installation of the image processing program, the image processing apparatus 400 changes to a state in which the image processing apparatus 400 can operate to perform image processing explained below. The image processing program can operate on a predetermined operating system (OS). The image processing program can form a part of specific application software.

Image formation explained below can be carried out on an inkjet printer side. However, in this example, the inkjet printer 500 does not have, in the apparatus, a function of generating a dot pattern actually recorded in response to a print command for drawing of an image or a character. In the example, a print command from application software or the like executed by the image processing apparatus 400, which functions a host, is subjected to image processing by a printer driver incorporated in the image processing apparatus 400 as software. Multi-value dot pattern data (printing image data) that can be output by the inkjet printer 500 is generated, rasterized, and transferred to the inkjet printer 500. The inkjet printer 500 print-outputs the data.

Specifically, in the image processing apparatus 400, a recording command for drawing of an image or a character (e.g., a command describing the position, the thickness, the shape, and the like of a line to be recorded or a command describing the font, the size, the position, and the like of a character to be recorded) from an application or an operating system is temporarily stored in a drawing data memory. These commands are described in a specific page description language.

The command stored in the drawing data memory is interpreted by a rasterizer. If the command is a recording command for a line, the line is converted into a recording dot pattern (print data) corresponding to a designated position, thickness, and the like. If the command is a recording command for a character, contour information of a corresponding character is invoked from font outline data stored in the image processing apparatus 400. The contour information is converted into a recording dot pattern corresponding to a designated position and size. If the contour information is image data, the contour information is directly converted into a recording dot pattern.

Thereafter, the recording dot pattern is subjected to image processing and stored in a raster data memory. At this point, the image processing apparatus 400 rasterizes, with a bigrating orthogonal grid set as a basis recording position, the recording dot pattern into data of the recording dot pattern. As the image processing, for example, there are color management processing (CMM) and γ correction processing for adjusting a color, halftone processing such as a dither method and an error diffusion method, base removal processing, and ink total amount regulation processing. The recording dot pattern stored in the raster data memory is transferred to the inkjet printer 500 through an interface.

When the recording dot pattern is copied using the inkjet printer 500, the inkjet printer 500 needs to apply the halftone processing or the like to the recording dot pattern. In that case, the printing control unit 207 applies the processing to scanned image data to generate a recording dot pattern subjected to the halftone processing or the like.

Image Processing Unit

In this embodiment, as an image forming method, so-called one-path print for forming an image on a recording medium in one main scanning can be used or so-called multi-path print for forming an image on a recording medium by applying a plurality of times of main scanning to the same area of the recording medium using the same nozzle group or different nozzle groups can be used. The heads 7 can be arranged in the main scanning direction to properly shoot dots to the same area with different nozzles. These recording methods can be used in combination as appropriate.

Figure 9:
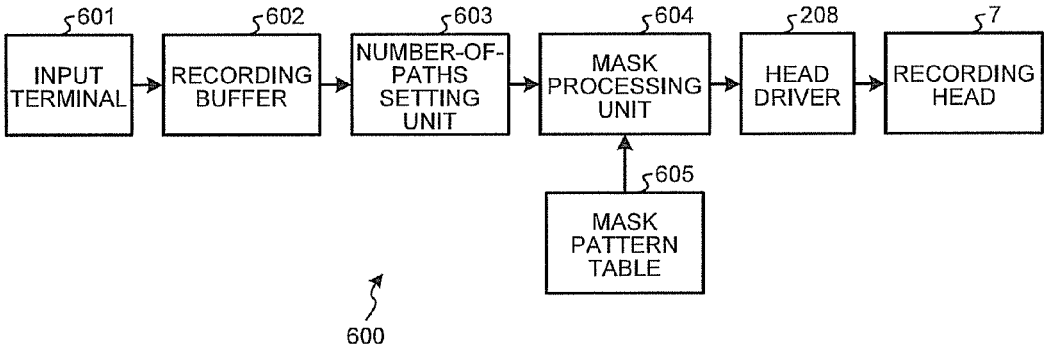
FIG. 9 is a schematic block diagram of an image processing unit.

The multi-path print is explained below. FIG. 9 is a schematic block diagram of an image processing unit 600 of the image forming apparatus (the inkjet printer 500) according to this embodiment. The image processing unit 600 includes an input terminal 601, a recording buffer 602, a number-of-paths setting unit 603, a mask processing unit 604, and a mask pattern table 605.

Bitmap data (print data) transmitted from the image processing apparatus 400 is input from the input terminal 601 and stored in a predetermined address of the recording buffer 602 by a recording-buffer control unit. The recording buffer 602 has a capacity enough for storing bitmap data for one scan and a paper feeding amount and configures a ring buffer in a paper feeding amount unit such as an FIFO memory.

The recording-buffer control unit controls the recording buffer 602, starts a printer engine when bitmap data for one scan is stored in the recording buffer 602, reads out the bitmap data from the recording buffer 602 according to the positions of the nozzles of the recording heads 7, and inputs the bitmap data to the number-of-paths setting unit 603. When bitmap data for the next scan is input from the input terminal 601, the recording-buffer control unit controls the recording buffer 602 to store the bitmap data in a space area (an area equivalent to a paper feeding amount for which recording is completed) of the recording buffer 602.

A more specific configuration example of the number-of-paths setting unit 603 in the image forming apparatus is explained. The number-of-paths setting unit 603 determines the number of divided paths and outputs the number of divided paths to the mask processing unit 604. The number-of-paths setting unit 603 selects, according to the determined number of divided paths, a necessary mask pattern from a mask pattern table stored in advance in the mask pattern table 605, for example, mask patterns of one-path recording, two-path recording, four-path recording, and eight-path recording and outputs the selected mask pattern to the mask processing unit 604.

The mask processing unit 604 masks, for each path recoding, the bitmap data stored in the recording buffer 602 using the mask pattern and outputs the bit map data to the head driver 208. The head driver 208 rearranges the masked bitmap data in order of use by the recording heads 7 and transfers the bitmap data to the recording heads 7.

The recording buffer 602 is realized by, for example, the RPM 203. The mask pattern table is stored in, for example, the ROM 202. The number-of-paths setting unit 603 and the mask processing unit 604 could be realized by the printing control unit 207, a combination of the printing control unit 207 and the CPU 201, or the CPU 201. The recording-buffer control unit could be realized by the CPU 201.

Mechanism of Occurrence of Color Unevenness

Print unevenness (color unevenness) control by the image forming apparatus according to this embodiment is explained below. However, first, a mechanism of occurrence of color unevenness is explained. In the following explanation in this embodiment, brightness is used as a characteristic for representing color unevenness. The color unevenness refers to un-uniformity of a color. The color unevenness may represent characteristics other than the brightness such as density and saturation. A difference in color unevenness is referred to as a brightness difference or a color difference.

Figure 10:
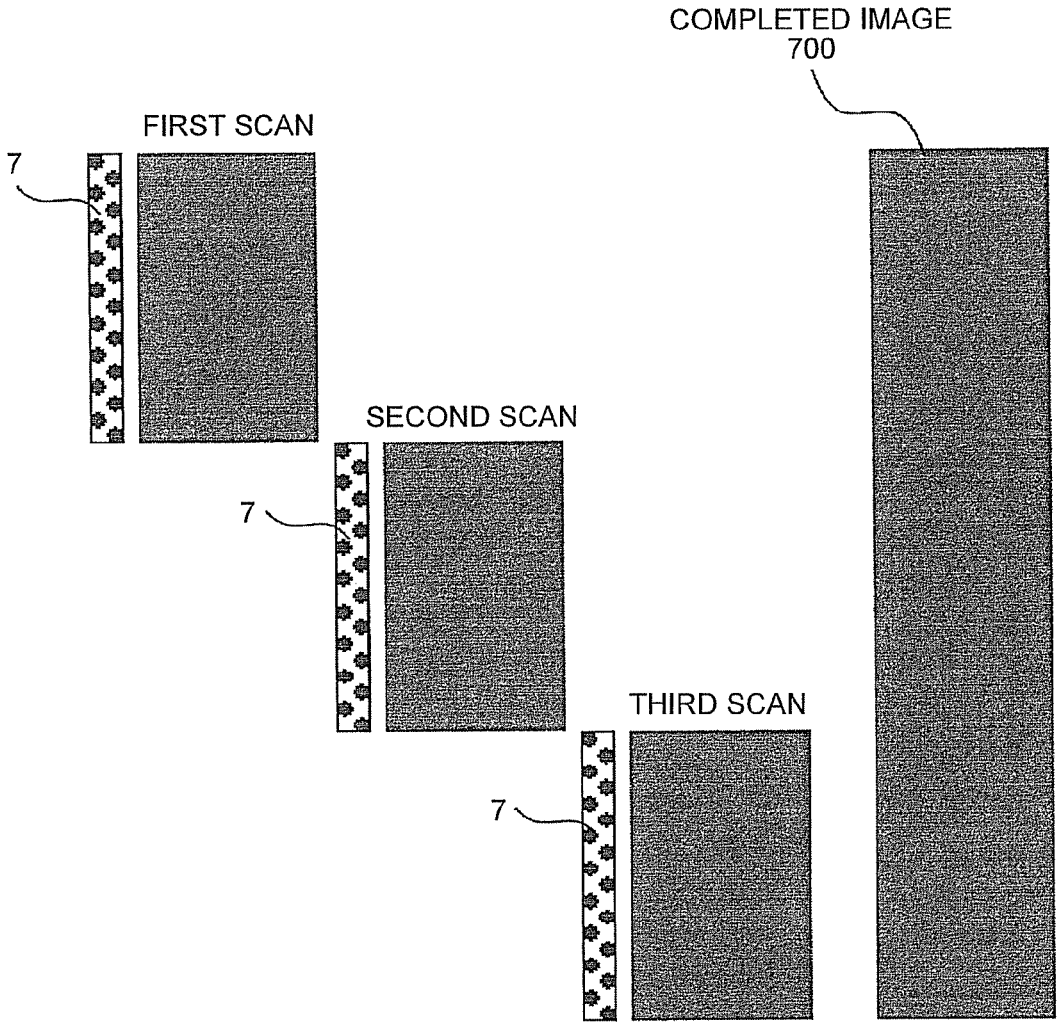
FIG. 10 is a diagram for explaining an example of image formation by a head without color unevenness.
Figure 11:
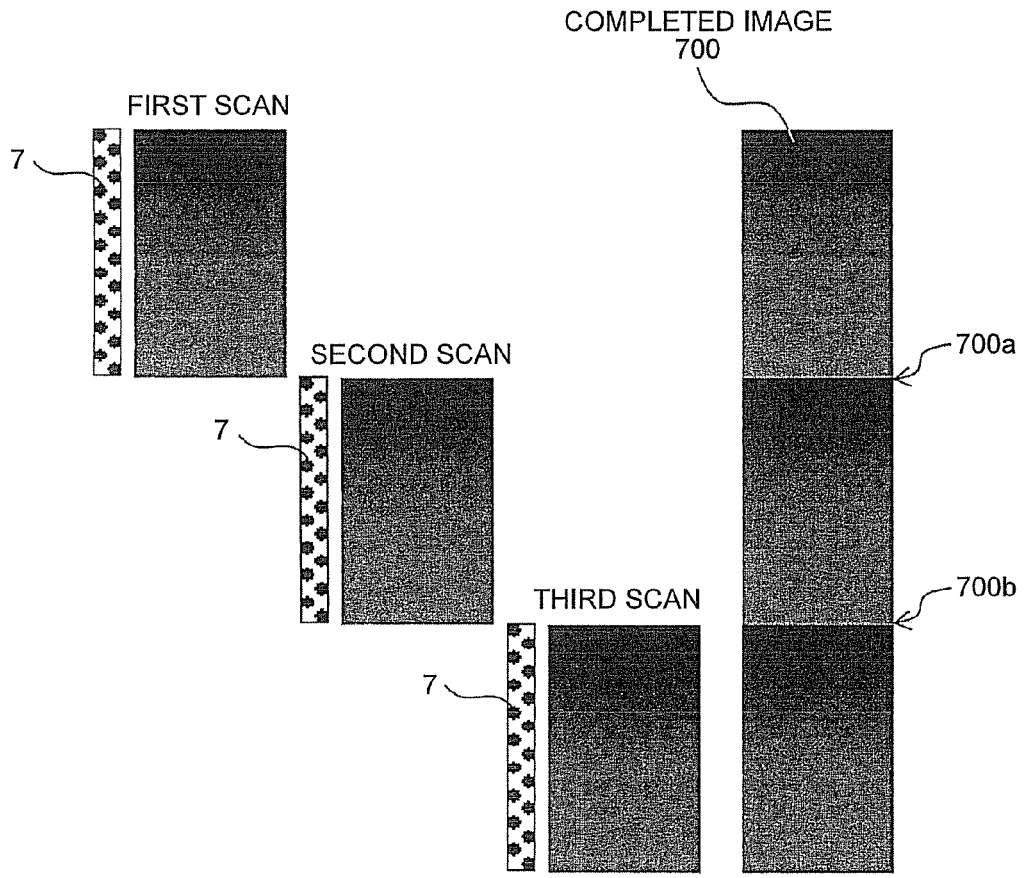
FIG. 11 is a diagram for explaining the example of the image formation by the head without color unevenness.

When print is performed using the image forming apparatus, if ejection characteristics of all the nozzles in the heads 7 are uniform (the heads have no color unevenness), a uniform image without color unevenness shown in FIG. 10 can be formed. However, if the ejection characteristics of the nozzles in the heads 7 are un-uniform (the beads have color unevenness), as shown in FIG. 11, color unevenness is conspicuous in an area of head width. FIGS. 10 and 11 are schematic diagrams for explaining completion of a completed image 700 shown on the right side in the figure by the execution of three times of scanning.

Concerning a result of image formation performed using the heads 7 having color unevenness shown in FIG. 11, even if a color change in one scan is within a tolerance, in boundary portions 700*a* and 700*b* with the next scan, a gap of a color change occurs, leading to an image failure.

In some case, image formation is performed by multi-scan to improve resolution and election stability. However, if the same area is scanned a plurality of times to perform image formation using the heads 7 having color unevenness, a color change is further highlighted.

Figures 12A, 12B, 12C, 12D:
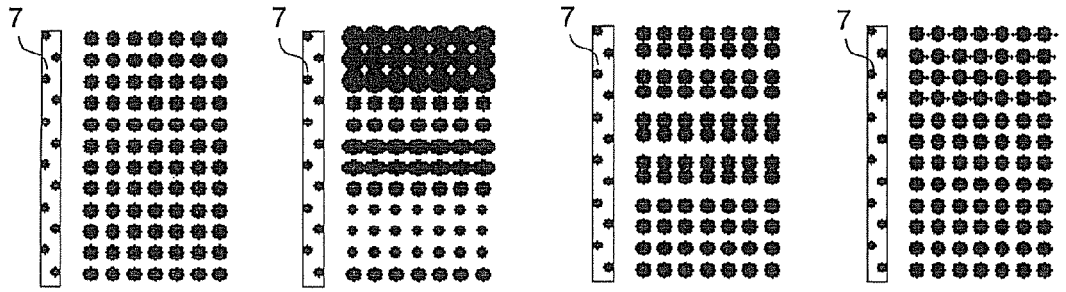
FIG. 12A is a diagram of an example of uniform arrival of dots for explaining occurrence of color unevenness.
FIG. 12B is a diagram of an example of fluctuation in the diameter and the arriving shape of the dots.
FIG. 12C is a diagram of an example of fluctuation in an arriving position of the dots.
FIG. 12D is a diagram of an example of satellite fluctuation of the dots.
Figure 13:
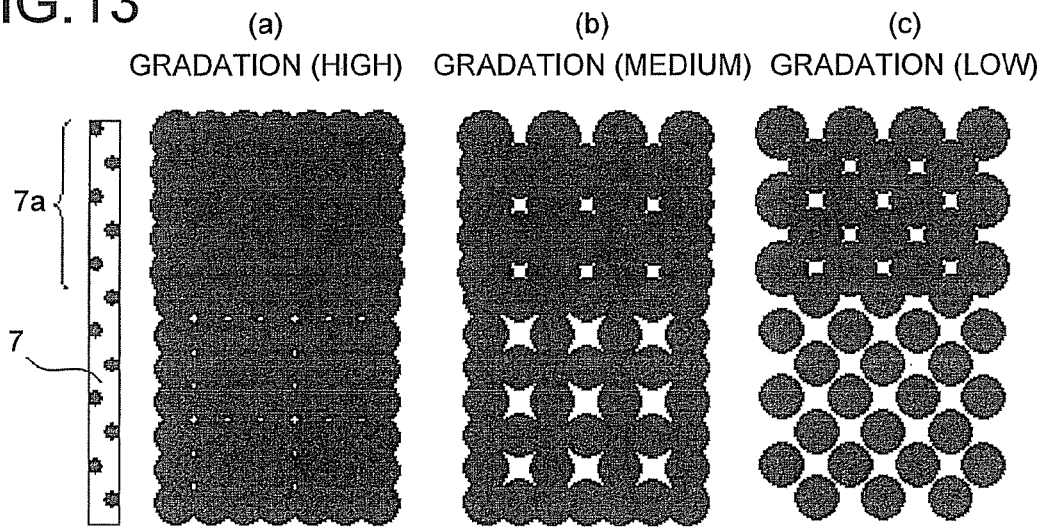
FIG. 13A is a diagram of an example of a high gradation for explaining an arrival change due to an output gradation.
FIG. 13B is a diagram of an example of an intermediate gradation.
FIG. 13C is a diagram of an example of a low gradation.

A factor causing color unevenness is explained. For example, as shown in FIG. 12A, when the sizes and the arriving positions of dots ejected by the nozzles are uniform, color unevenness does not occur. On the other hand, when the sizes, the shapes, the arriving positions, and the like of elected dots are different depending on manufacturing variations or the like for each of the nozzles, as shown in FIGS. 12B and 12C, unevenness of ink coverage on the paper surface occurs, leading to color unevenness.

In the image forming apparatus of the inkjet system, when droplets are ejected, because of trailing or the like of the droplets being ejected, unintended dots are formed separately from dots originally desired to be ejected (called satellite). It is difficult to completely eliminate occurrence oil satellite. It is often impossible to control arrival positions. Therefore, color unevenness is sometimes caused by presence or absence of satellite and fluctuation in arrival positions (FIG. 12D).

Therefore, it is important to correct ejection characteristics of the heads 7 to make ejection characteristics of the nozzles uniform and reduce color unevenness. As a method of correcting the ejection characteristics of the heads 7, for example, a method of adjusting a driving voltage applied to the heads 7 to control dot diameters and correct color unevenness is conceivable. However, it is difficult to correct a voltage in a finer unit such as the inside of the heads and the configuration of the apparatus is complicated, leading to an increase in cost of the apparatus.

When the dot diameters are controlled according to a voltage, the strength of ejection of the nozzles is uniformly changed. However, the influence of the problem of color unevenness appears in a different way depending on gradation to be output. For example, when a part of the nozzles (the nozzles in an area 7*a* in FIG. 13) in the heads 7 are nozzles having dot diameters larger than a desired dot diameter, as shown in (a) of FIG. 13, near solid (high gradation), because the paper surface is already filled with ink, a difference hardly occurs in an ink coverage amount on the paper surface and color unevenness less easily occurs. However, as shown in (b) and (c) of FIG. 13, at gradations with less dot formation amounts (an intermediate gradation and a low gradation), the sizes of dots tend to lead to an ink coverage amount of the paper surface and color unevenness tends to become conspicuous.

A way of fluctuation on the ejection side is also sometimes different depending on a type of dots to be output and a way of shoot the dots. For example, a way of fluctuation is sometimes different because a recording frequency (recording density) is different. The image forming apparatus of the inkjet system ejects ink by applying pressure to the liquid chamber of the heads 7. Therefore, even if the image forming apparatus performs control to eject droplets of the same size, vibration of droplet surfaces and ink supply speed to the liquid chamber are different depending on an ejection period of the droplets.

As a result, ejection characteristics of dots are different depending on the ejection period.

Figure 14:
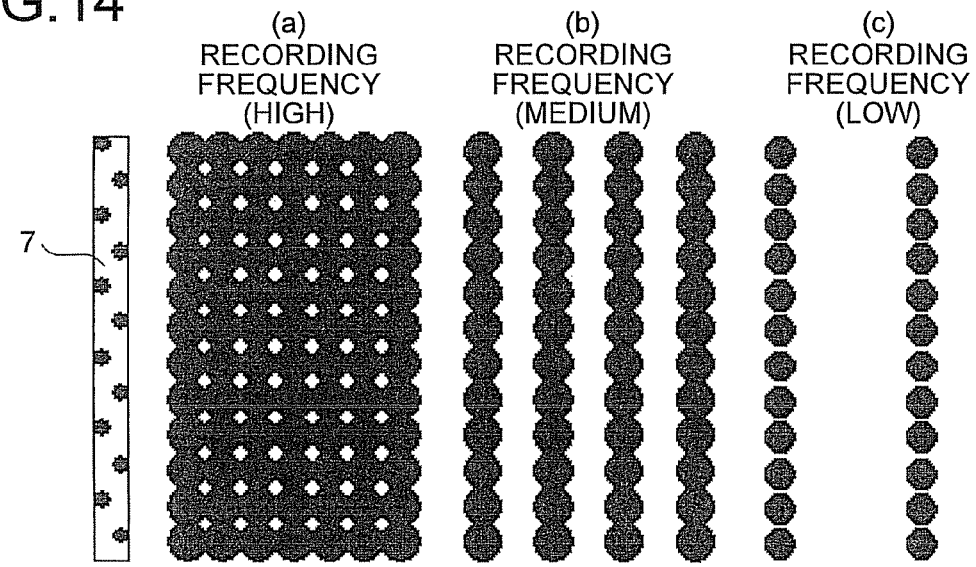
FIG. 14A is a diagram of an example of a high recording frequency for explaining an arrival change due to a recording frequency.
FIG. 14B is a diagram of an example of an intermediate recording frequency.
FIG. 14C is a diagram of an example of a low recording frequency.

Consequently, for example, as shown in (a) to (c) of FIG. 14, even if the same dots are formed in print data, a difference could occur in dots arriving on the actual paper surface between a high recording frequency and a low recording frequency.

Figure 15:
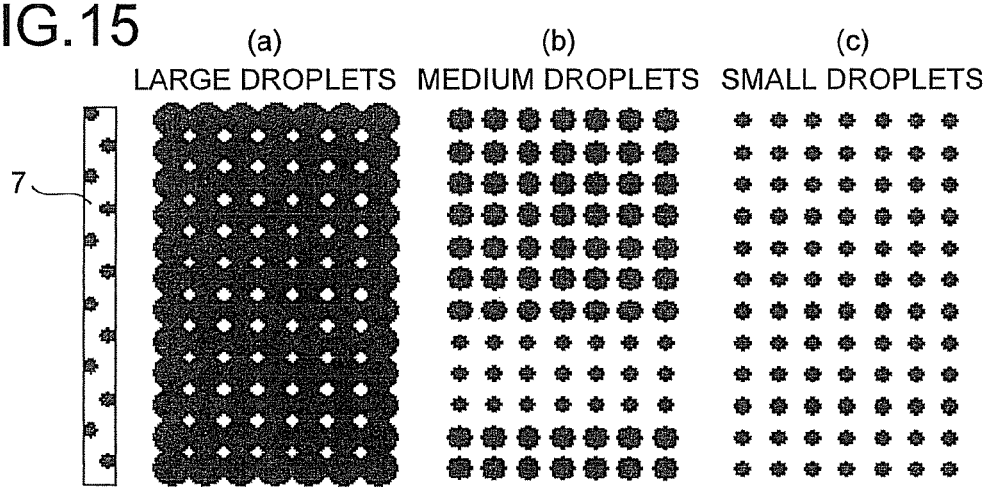
FIG. 15A is a diagram of an example of large droplets for explaining an arrival change due to a droplet type.
FIG. 15B is a diagram of an example of medium droplets.
FIG. 15C is a diagram of an example of small droplets.

As explained above, the image forming apparatus according to this embodiment properly shoots dots having different sizes (large droplets, medium droplets, and small droplets) and ejects multi-value droplets of a plurality of types. Therefore, in some case, a way of vibration of nozzle liquid surfaces is different depending on a droplet type and a way of fluctuation is different depending on a droplet type. The same holds true in a head that includes a plurality of nozzles having different nozzle diameters and ejects a plurality of types of droplets having different sizes. In such a case, it is also likely that only specific droplets tend to fluctuate. FIG. 15 illustrates examples of print results obtained when characteristics are different depending on a droplet type (a) to (c). In the example shown in (h) of FIG. 15, only a part of medium droplets have different characteristics.

When there is such fluctuation in characteristic, in the correction method for uniformly controlling the strength of ejection as in the correction by a voltage, a difference in characteristics different for each gradation cannot be completely corrected. If the ejection strength is uniformly corrected, a correction result leads to deterioration of color unevenness to the contrary.

Therefore, it is necessary to perform color correction not only for the nozzles but also for gradations output by the nozzle (gradation correction). It is desirable to correct input and output characteristics as in γ correction (for correcting a gradation of an image to an optimum curve corresponding to a gamma value of an input and output device).

However, to perform correction in a fine unit such as each nozzle as explained above, an enormous number of correction parameters calculated as "the number of heads×the number of nozzles×the number of gradations" are necessary. In some case, a way of occurrence of color unevenness is different depending on a print mode or an apparatus environment change. Therefore, if the print mode and the apparatus environment change are also corrected, a more enormous number of parameters are necessary. For example, when various measurement devices are mounted on the apparatus and correction is performed on a real time basis, man-hour required for the correction including the number of output images for measurement, the number of measuring points, and the number of created parameters is enormous. Therefore, it is unrealistic to perform different corrections for all the nozzles. As correction control for the image forming apparatus, it is realistic to perform correction in a large area unit to some extent.

Figure 16A:
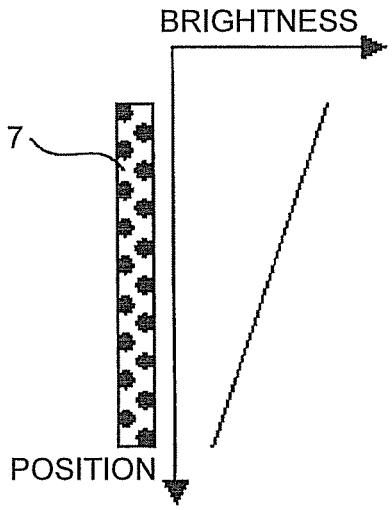
FIG. 16A is a graph of a relation between a head position and brightness.

However, as explained above, the problems such as a brightness difference and a pattern change occur in the boundary portions of the area to be corrected. Specifically, for example, as shown in FIG. 16A, it is assumed that there is a head having a brightness gradient from an upper part to a lower part of the head 7 (the head has a characteristic that the brightness is high on the upper side of the head and gradually decreases toward the lower side of the head in the figure). When the head is divided into two segments and correction is performed, for example, as shown in FIG. 16B, it is conceivable to match averages of the respective segments.

Figure 16B:
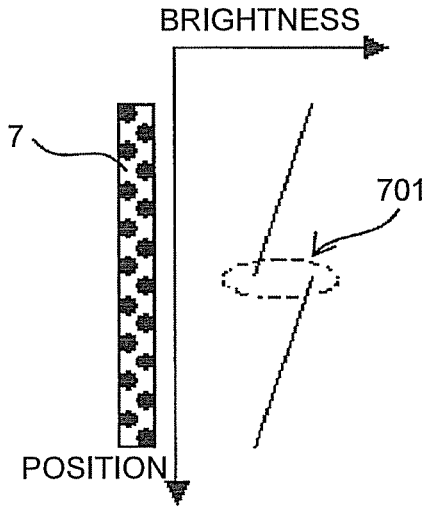
FIG. 16B is a graph of a relation between a head position and brightness in the case of correction by division.
Figures 17A, 17B, 17C, 17D, 17E:
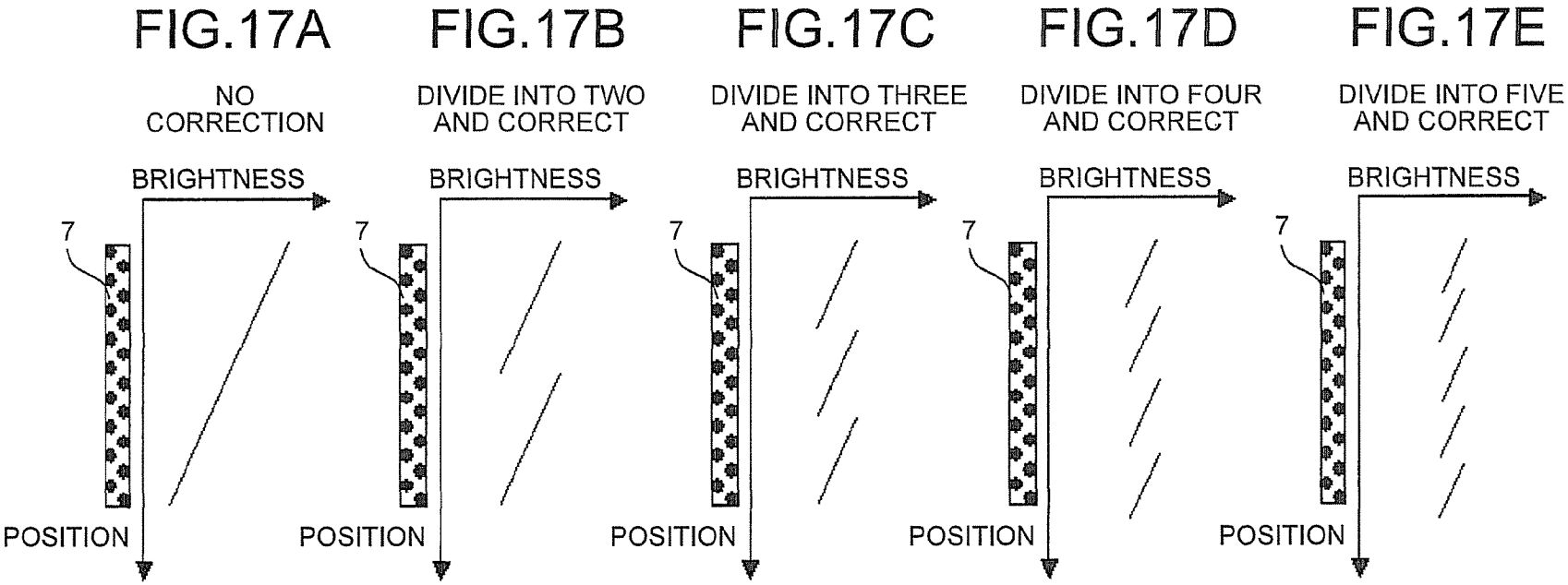
FIG. 17A is a graph of a relation between a head position and brightness in the case of no division of an area to be corrected.
FIG. 17B is a graph in the case of the area divided into two correction segments.
FIG. 17C is a graph in the case of the area divided into three correction segments.
FIG. 17D is a graph in the case of the area divided into four correction segments.
FIG. 17E is a graph in the case of the area divided into five correction segments.

As shown in FIG. 16B, when averages are calculated to perform correction, a difference between a maximum and a minimum of brightness in the head decreases. Because a brightness difference between the upper end of the head and the lower end of the head also decreases, when the head 7 starts a new line (scanning in the next area), a brightness difference in a joint of lines also decreases. However, a new brightness difference occurs in a portion jointing the correction segments (i.e., an intermediate portion of the head 7) 701. This leads to color unevenness.

Further, as shown in FIGS. 17A to 17E, the problem of the brightness difference in the portion jointing the correction segments is reduced by increasing the number of divisions for correction (also referred to as the number of divisions) and reducing each of the correction segments. However, as in the correction in the nozzle unit, the number of parameters and a parameter creation processing amount increase.

In the examples shown in FIGS. 16A and 16B, the head having the brightness gradient from the upper part to the lower part of the head 7 is shown. However, the brightness characteristics of the head 7 are not limited to the examples shown in FIGS. 16A and 16B. There are brightness characteristics having an opposite brightness gradient, brightness characteristics having partially different characteristics, and brightness characteristics having characteristics changing in a mountain shape and a valley shape. A change amount of the brightness gradient is also sometimes different. Therefore, even if the inside of the head is simply divided into a plurality of segments and correction is performed, in some case, a sufficient correction effect cannot be obtained.

Color Unevenness Reduction Control

Figure 19:
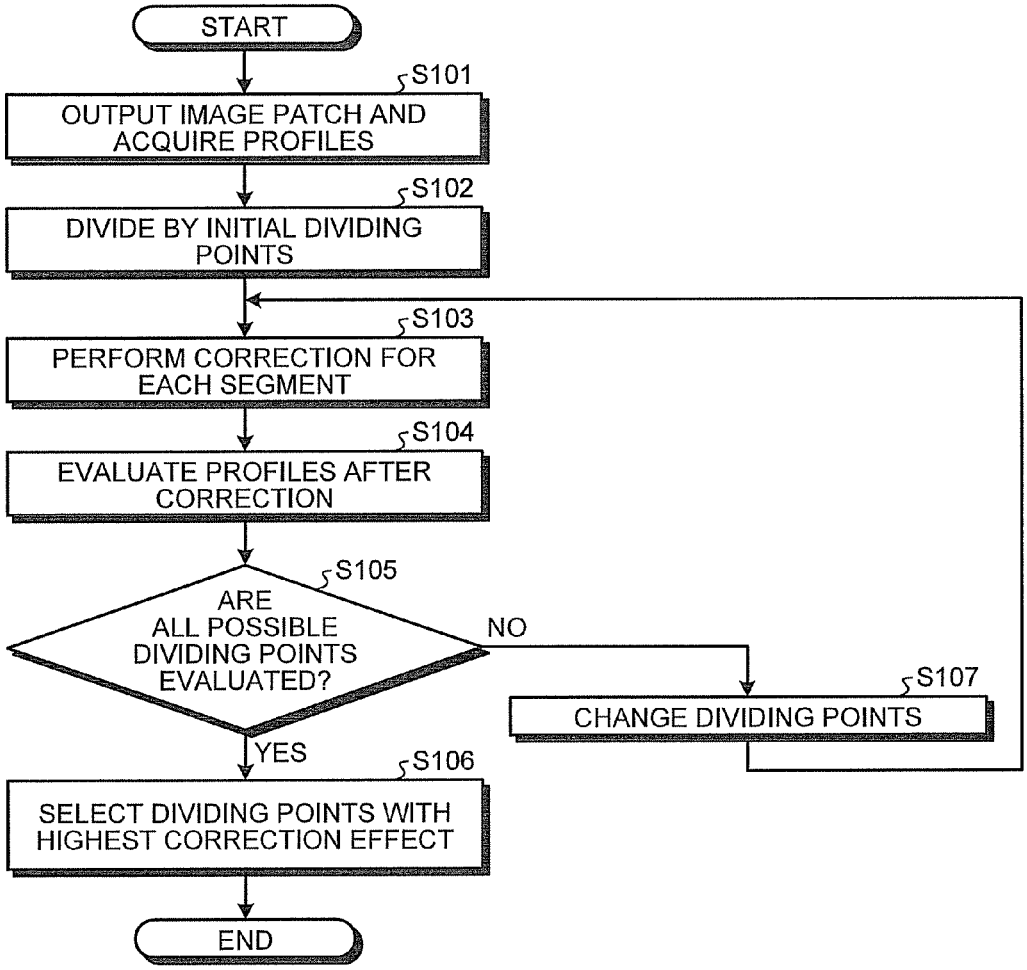
FIG. 19 is a flowchart for explaining an example of a correction area division processing for varying dividing points.

Therefore, the image forming apparatus according to this embodiment includes, for example, the correcting unit 240 (FIG. 5) that divides the recording head 7 by different division patterns each indicating that the recording head is divided into a plurality of segments by at least one different dividing point, corrects input and output characteristics for each of the segments in each division pattern to calculate correction effect of the each division pattern, and determines one of the division patterns based on the calculated correction effects of the division patterns as a specified division pattern to correct input and output characteristics of the recording head 7 (see FIG. 19, etc.). In this way, the image forming apparatus acquires characteristic profiles of the recording head 7 and divides the area to be corrected (the recording head 7) by points where a more effective correction effect can be obtained even if the number of divisions for correction is the same.

Figure 18:
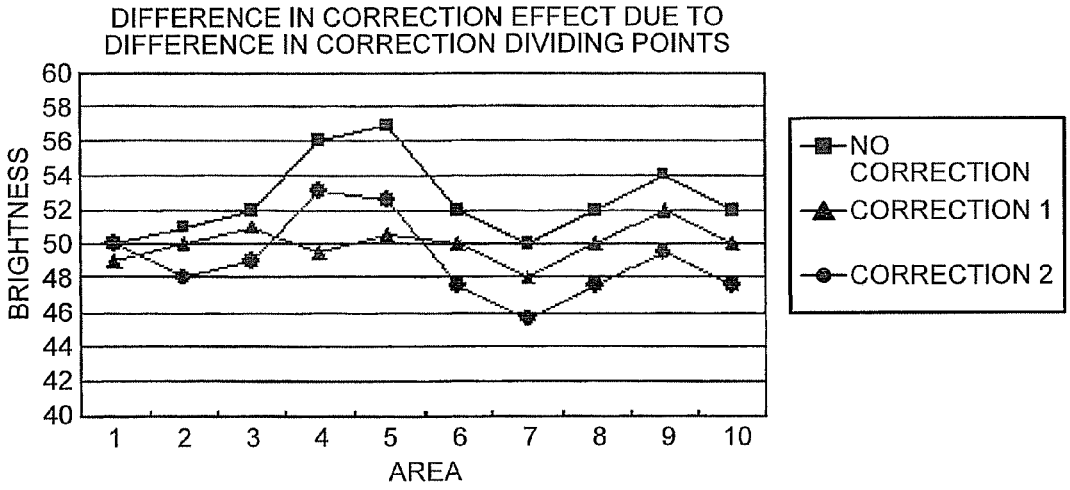
FIG. 18 illustrates a difference in a correction effect due to a difference in dividing points (a) and a schematic diagram of a recording head subjected to division (b)
Figure 18:
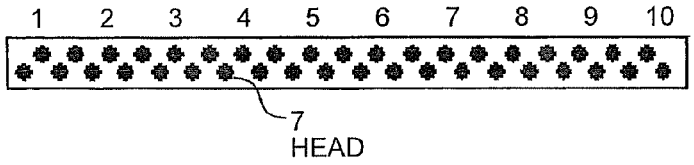

First, a difference in a correction effect obtained when dividing points for correction, which may be referred to as segmentation positions, are changed is explained. FIG. 18 illustrates measurement of brightness information (brightness measurement data) concerning areas (ten areas 1 to 10) in the head shown in (b) of FIG. 18 and correction of the brightness information in (a) of FIG. 18.

A graph marked "no correction" in (a) of FIG. 18 indicates a characteristic in the head 7 in which correction is not carried out. It is seen that unevenness of the characteristic is large in the same head. A graph marked "correction 1" indicates a characteristic obtained when the head 7 is divided into three segments of areas 1 to 4, areas 5 to 7, and areas 8 to 10 and correction is performed to match averages of the respective segments (in the example shown in (a) of FIG. 18, brightness averages of the segments are adjusted to 50). A graph marked "correction 2" indicates a characteristic obtained when the head 7 is divided into different three segments of areas 1 to 3, areas 4 and 5, and areas 6 to 10 and correction is performed to match averages of the respective segments (in the example shown in (a) of FIG. 18, brightness averages of the segments are adjusted to 50).

In "correction 1" and "correction 2", because the numbers of divisions of the head 7 are the same at three, brightness measurement data and the number of correction parameters necessary for correction are also the same. However, their correction effects are different. In "correction 1", fluctuation in the head can be reduced to be smaller than fluctuation in "correction 2".

In this way, characteristic shapes of the heads 7 are not uniform. Even if the number of divisions (i.e., the number of segments) is the same, a correction result changes depending on where boundary points of division are set. Therefore, as explained in detail below, the image forming apparatus according to this embodiment simulates correction effects obtained in different division patterns each having a different set of dividing points and divides the head 7 by dividing points of the division pattern having high correction effect to thereby perform correction adjusted to the characteristics of the heads 7.

Correction conditions and characteristic profiles set as an evaluation reference for a correction effect in performing correction are explained. First, an image patch is output. The characteristic profiles are acquired based on the brightness, the luminance, or the like of the output image patch by a reading unit such as a scanner, a sensor, or a spectrophotometer. Search and correction of the correction conditions are carried out based on the characteristic profiles.

In the example explained in this embodiment, brightness is used to acquire the characteristic profiles. However, the characteristic profiles can be acquired based on image characteristic information other than the brightness such as density, saturation, and luminance. A dot diameter, an ink coverage area, or the like can be detected and search and correction of the correction conditions can be carried out based on the dot diameter, the ink coverage area, or the like (details of a method of determining a target value of correction and correction processing are explained later).

Correction Area Division Processing 1

Processing for dividing the correction area is explained. Brightness profiles after correction for adjusting, while changing dividing points of the correction area, a brightness average of respective correction segments to a target value are calculated. A set of dividing points (division pattern) with high correction effects are calculated.

Correction area division processing for fixing the number of divisions and varying dividing points is explained with reference to flowcharts of FIGS. 19 and 20.

In the correction area division processing shown in FIG. 19, first, the image forming apparatus outputs an image patch and acquires characteristic profiles using the reading unit (S101). The image forming apparatus divides the head 7 into correction segments by predetermined dividing points (initial dividing points set in advance) (S102).

The image forming apparatus performs correction for each of the segments (S103). The image forming apparatus evaluates a degree of a correction effect for the characteristic profiles after the correction (S104). Subsequently, the image forming apparatus determines whether the evaluation (S104) for all possible dividing points ends (S105) when the evaluation does not end NO at S105), the image forming apparatus changes the dividing points (S107) and the processing returns to S103. On the other hand, when the evaluation for all the dividing points ends (YES at S105), the image forming apparatus selects a set of dividing points (division pattern) most highly evaluated (i.e., a correction effect is the highest) as dividing points used for correction (S106). In the example shown in FIG. 19, the image forming apparatus performs the evaluation for all sets (combinations) of the dividing points and determines a set of dividing points where the highest correction effect.

Figure 20:
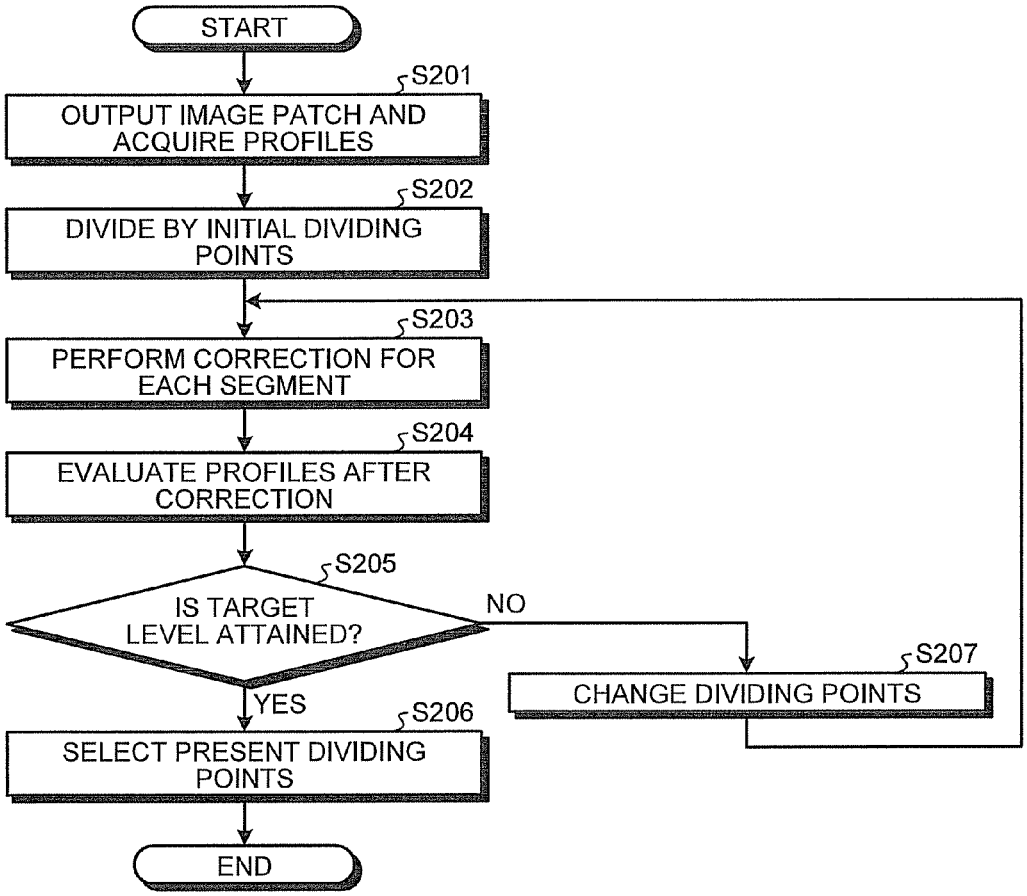
FIG. 20 is a flowchart for explaining another example of the correction area division processing for varying dividing points.

The correction area division processing shown in FIG. 20 is explained. Explanation of S201 to S204 is omitted because S201 to S204 respectively correspond to S101 to S104.

After the evaluation processing (S204), the image forming apparatus determines whether a desired target level of correction effect set in advance is attained (S205). When the target level is not attained (NO at S205), the image forming apparatus changes the dividing points (S207) and the processing returns to S203. On the other hand, when the target level is attained (YES at S205), the image forming apparatus selects the set of the dividing points as dividing points used for correction (S206). In the example shown in FIG. 23, the image forming apparatus does not perform the evaluation for all combinations of the dividing points. The image forming apparatus ends the processing immediately after dividing points where a target level of correction effect (or a correction effect higher than the target level) can be obtained is detected.

The correction area division processing for varying dividing points for the correction segments can be any one of the methods explained above. In the example shown in FIG. 19, a set of dividing points with a large processing amount and the highest correction effect can be found. In the example shown in FIG. 20, dividing points where a desired correction effect is obtained can be quickly obtained.

In the example shown in FIG. 20, when there is no set of dividing points that satisfies a target level, as in FIG. 19, dividing points most highly evaluated among the evaluated sets of dividing points only have to be calculated when the correction cannot attain the target level, it is likely that there is a failure of the apparatus. Therefore, it is desirable to include a notifying unit for notifying the outside to that effect. For example, an output unit that outputs a message for urging maintenance or a contact with an apparatus support source and a transmitting unit that transmits a state of the apparatus to the apparatus support source via a network in a network environment are provided to notify a failure of the apparatus. Consequently, it is possible to urge quick measures.

In the example shown in FIG. 19, conditions with a highest correction effect can be selected. In this case, as in FIG. 20, it is desirable to provide a notifying unit that notifies the outside of a state of the apparatus when evaluation in calculated dividing points does not attain an effect target level.

Evaluation Processing

The processing for evaluating a degree of the evaluation effect (S104 and S204) is explained. Basically, concerning the heads 7, a flat characteristic without color unevenness (a state in which fluctuation is so little that it is unnecessary to perform correction) is a target level. Therefore, it is determined whether conditions are close to the flat characteristic.

As a determining method, for example, the determination only has to be performed based on variance, change ranges of brightness profiles, a sum or a root means square (RMS) of differences from an average, or a combination of the forgoing. In some case, ranges of fluctuation and change in the head are small but a sudden change occurs only at a certain point. Such a sudden change in a characteristic is observable. Therefore, for example, the brightness profiles can be differentiated to add an amount of change of the brightness profiles to determination criteria. Besides, publicly-known determination methods can be used.

These methods are methods of determining to which degree a plurality of conditions are apart from the target or whether the conditions satisfy predetermined criteria. Therefore, all the characteristics are desirably have smaller absolute values.

An evaluation formula obtained by weighting the conditions can be created to perform the determination based on the evaluation formula. For example, the determination can be performed according to a condition having a smallest variance or RMS. For example, a condition having a smallest variance among conditions in which a maximum—a minimum of brightness differences and a maximum—a minimum of differential values are within specified values can be selected.

In the evaluation of the correction effect, it is desirable to evaluate profiles taking into account a difference between the upper end and the lower end of the head 7 as well. This is because, as shown in FIGS. 10 and 11, when the head 7 starts a new line and performs print, because an image printed by the upper end of the head 7 and an image printed by the lower end of the head 7 are adjacent to each other, a brightness difference in this boundary portion also occurs. Therefore, in the profile evaluation, it is more desirable to evaluate the profiles from length equal to or larger than one head taking into account a connecting portion of the upper end and the lower end of the head 7. As explained above, dividing points for the correction segments for enabling effective correction are determined and correction is carried out for each of the correction segments.

Correction Area Division Processing 2

If the number of divisions for the correction segments (i.e., the number of correction segments of the heads) is increased, the correction effect can be improved. However, a processing amount related to the correction increases. On the other hand, if the number of divisions is reduced, although the correction effect is low, the processing amount can also be reduced. The number of divisions necessary for correction is considered to be different for each of the characteristics of the heads 7. Therefore, in the correction area division processing, it is possible to perform more effective correction by varying the number of correction segments.

The correction area division processing for varying the number of divisions for the correction segments is explained with reference to flowcharts of FIGS. 21 and 22. Dividing points only have to be set as predetermined points for each number of divisions.

Figure 21:
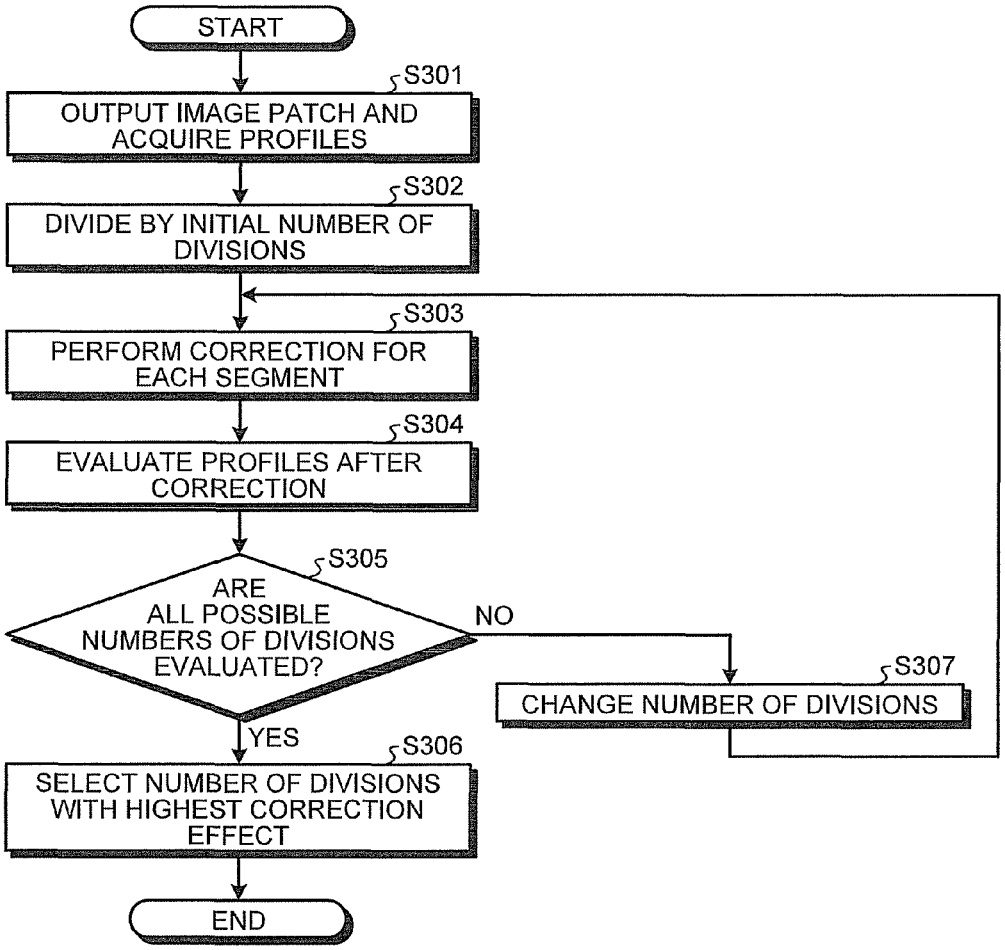
FIG. 21 is a flowchart for explaining an example of correction area division processing for varying the number of correction segments.

In the correction area division processing shown in FIG. 21, first, the image forming apparatus outputs an image patch and acquires characteristic profiles using the reading unit (S301). The image forming apparatus divides the head 7 by a predetermined number of divisions (an initial number of divisions set in advance) (S302).

The image forming apparatus performs correction for each of the segments (S303). The image forming apparatus evaluates a degree of a correction effect for the characteristic profiles after the correction (S304). Subsequently, the image forming apparatus determines whether the evaluation (S304) for all possible numbers of divisions ends (S305). When the evaluation does not end (NO at S305), the image forming apparatus changes the number of divisions (the number of divisions is incremented) (S307) and the processing returns to S303. On the other hand, when the evaluation for all the numbers of divisions ends (YES at S305), the image forming apparatus selects the number of divisions most highly evaluated (i.e., a correction effect is the highest) as the number of divisions to be calculated (S306). In the example shown in FIG. 21, the image forming apparatus performs the evaluation for all sets (combinations) of the numbers of divisions and the number of divisions with a highest correction effect is calculated.

Figure 22:
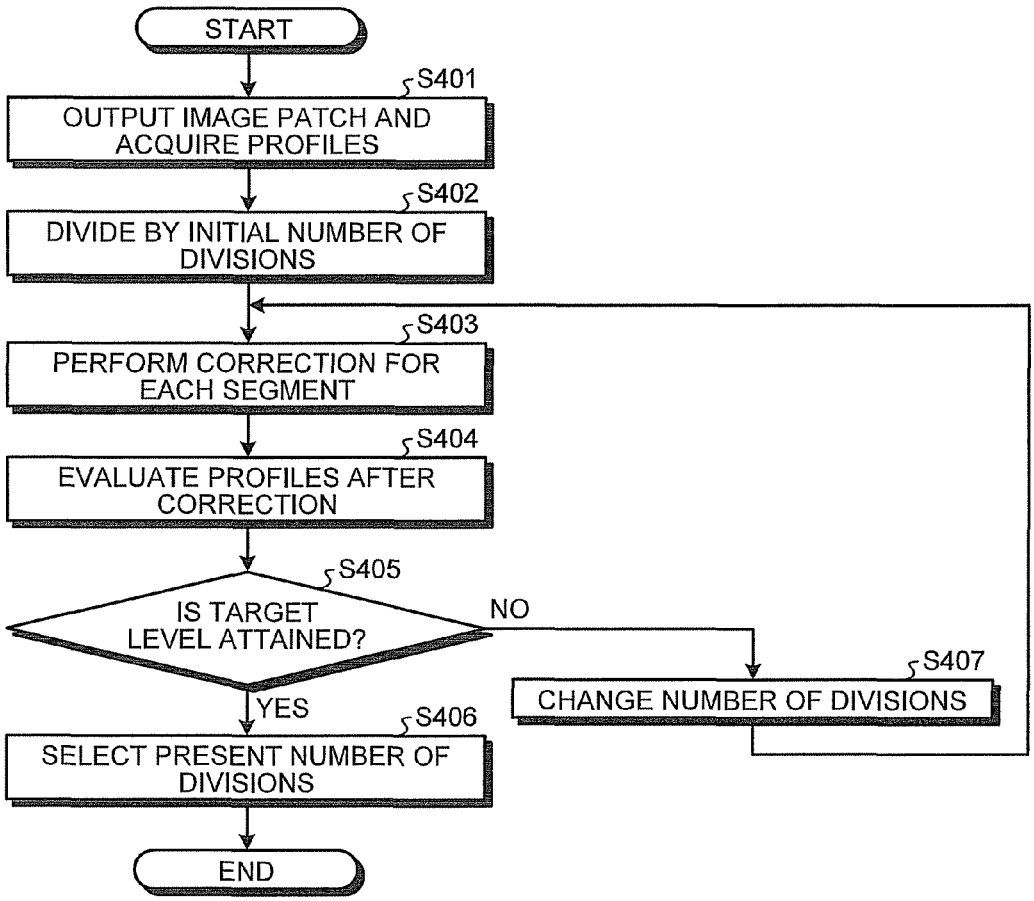
FIG. 22 is a flowchart for explaining another example of the correction area division processing for varying the number of correction segments.

The correction area division processing shown in FIG. 22 is explained. Explanation of S401 to S404 is omitted because S401 to S404 respectively correspond to S301 to S304.

After the evaluation processing (S404), the image forming apparatus determines whether a desired target level of correction effect set in advance is attained (S405). When the target level is not attained (NO at S405), the image forming apparatus changes the number of divisions (S407) and the processing returns to S403. On the other hand, when the target level is attained (YES at S405), the image forming apparatus selects the number of divisions as the number of divisions for correction (S406). In the example shown in FIG. 22, the image forming apparatus does not perform the evaluation for all combinations of the numbers of divisions. The image forming apparatus ends the processing is ended immediately after a smallest number of divisions with which a target correction effect (or a correction effect higher than the target correction effect) can be obtained is detected.

The correction area division processing for varying the number of divisions for the correction segments can be any one of the methods explained above. In the example shown in FIG. 21, the number of divisions with a large processing amount and a highest correction effect can be found. In the example shown in FIG. 22, the number of divisions that satisfies a desired correction effect can be quickly calculated.

In principle, the correction effect is higher as the number of divisions is larger. As shown in FIG. 16B, when the area division correction is carried out, in some case, a sudden change of characteristics is caused in the boundaries of the correction segments. In such a case, superiority and inferiority of effects could be reversed depending on the characteristics of the head 7 and the determination conditions for a correction effect. Therefore, as shown in FIG. 21, it is effective to perform the evaluation for all combinations of the numbers of divisions. However, in principle, the correction effect is higher as the number of divisions is larger. Therefore, in the search, it is desirable to perform the search in order from a maximum of the numbers of correction divisions that can be set. Rather than searching through all the conditions, it is also possible to reduce the number of divisions by a predetermined number at a time and determine the number of correction divisions out of the numbers of divisions.

In the example shown in FIG. 22, first, a correction effect is calculated concerning division correction performed with a small number of correction divisions. When the correction effect cannot clear the target level, the number of divisions is increased and the correction effect is carried out again. This is repeated until a correction result satisfies the target level. However, this is not a imitation. For example, conversely, a minimum number of divisions with which the target level can be attained can be detected in order from a largest number of divisions to a smallest number of divisions. It is also desirable to perform processing for first evaluating a correction effect with an intermediate number of divisions and, when the target level is attained, performing the search in a direction in which the number of divisions decreases and, when the target level is not attained, performing the search in a direction in which the number of divisions increases.

The other processing such as the evaluation processing (S304 and S404) is the same as the processing in the example explained above. Therefore, explanation of the processing is omitted. As explained above, for example, conditions with a highest correction effect are selected when the target level cannot be attained, the conditions are compared with the target level when optimum conditions are set, it is desirable to provide means for notifying the outside of a state of the apparatus when the target level cannot be attained, and it is desirable to also take into account the connecting portion of the upper end and the lower end of the head 7 in the evaluation.

Correction Area Division Processing 3

As explained above, a correction effect is different depending on dividing points of the area even if the number of divisions is the same. The correction effect is improved when the number of divisions is increased. Therefore, in the correction area division processing, it is possible to perform more effective correction while suppressing a processing amount related to the correction by varying both of the number of divisions and dividing points for the correction segments.

The correction area division processing for varying the number of divisions and dividing points for the correction segments is explained with reference to flowcharts of FIGS. 23 and 24.

Figure 23:
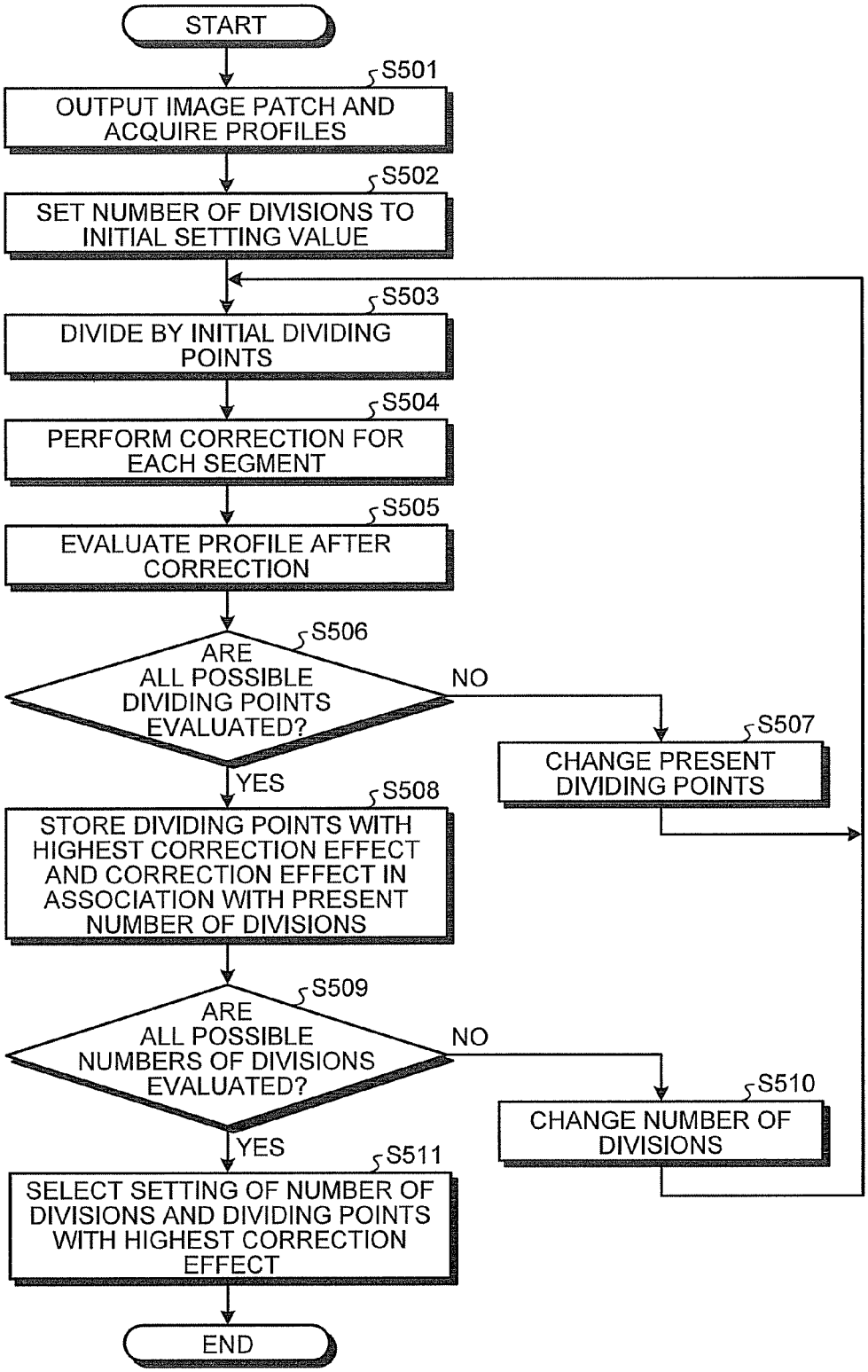
FIG. 23 is a flowchart for explaining an example of correction area division processing for varying the number of correction segments and dividing points.

In the correction area division processing shown in FIG. 23, first, the image forming apparatus outputs an image patch and acquires characteristic profiles using the reading unit (S501). The image forming apparatus sets the number of divisions to an initial setting value (S502).

The image forming apparatus performs division according to predetermined dividing points (initial dividing points set in advance) (S503) and corrects each of the divided segments (S504). The image forming apparatus evaluates a degree of a correction effect concerning the characteristic profiles after the correction (S505).

Subsequently, the image forming apparatus determines whether the evaluation (S505) for all possible sets of dividing points ends (S506). When the evaluation for all the possible sets of dividing points does not end (NO at S506), the image forming apparatus changes the dividing points (S507) and the processing returns to S503.

On the other hand, when the evaluation for all the possible sets of dividing points ends (YES at S506), the image forming apparatus temporarily stores a set of dividing points most highly evaluated (i.e., a correction effect is the highest) and a correction effect at that point in the RAM 203 or the like in association with the present number of divisions (S508).

Subsequently, she image forming apparatus determines whether the evaluation (S505) for all possible numbers of divisions ends (S509). When the evaluation for all the possible numbers of divisions does not end (NO at S509), the image forming apparatus changes the number of divisions (S510) and the processing returns to S503. On the other hand, when the evaluation for all the possible numbers of divisions ends (YES at S509), the image forming apparatus selects setting of the number of divisions and the set of dividing points most highly evaluated (i.e., a correction effect is the highest) as the number of divisions and the set of dividing points to be calculated (S511).

In this way, in the example shown in FIG. 23, first, the number of divisions is fixed. Dividing points are allotted according to the number of divisions and optimum set of dividing points are searched. Subsequently, under conditions in which the number of divisions is changed, optimum set of dividing points in the number of divisions are searched. This processing is repeated to find a combination of the number of area divisions and the set of dividing points for the correction segment with a highest correction effect.

Figure 24:
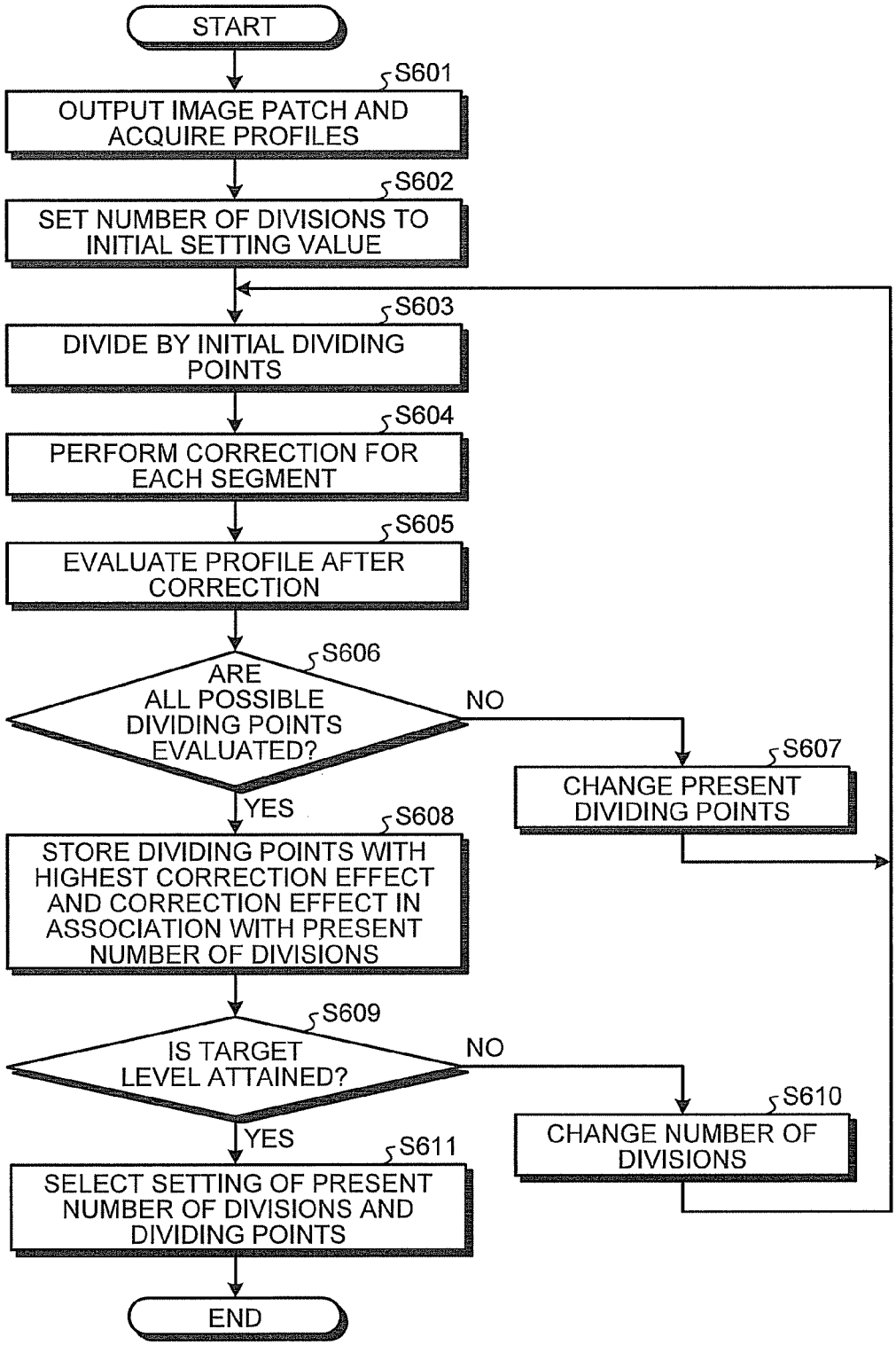
FIG. 24 is a flowchart for explaining another example of the correction area division processing for varying the number of correction segments and dividing points.

The correction area division processing shown in FIG. 24 is explained. Explanation of S601 to S608 is omitted because S601 to S608 respectively correspond to S501 to S508.

After storing the set of dividing points most highly evaluated (i.e., a correction effect is the highest) and a correction effect at that point in association with the present number of divisions (S608), the image forming apparatus determines whether a desired target level of correction effect set in advance is attained (S609). When the target level is not attained (NO at S609), the image forming apparatus changes the number of divisions (S610) and the processing returns to S603. On the other hand, when the target level is attained (YES at S609), the image forming apparatus selects the present setting of the number of divisions and the set of dividing points as the number of divisions and the set of dividing points used for correction (S611).

In this way, in the example shown in FIG. 24, first, the number of divisions is fixed. Dividing points are allotted according to the number of divisions and optimum set of dividing points are searched. It is determined whether a target can be attained under the conditions. When the target cannot be attained, the number of divisions is increased, dividing points are allotted, and optimum set of dividing points in the number of divisions is searched, and it is determined whether the target level can be attained under the conditions. This processing is repeated to find a minimum number of divisions and optimum set of dividing points with which the target level can be attained.

The other processing such as the evaluation processing (S505 and S605) is the same as the processing in the example explained above. Therefore, explanation of the processing is omitted. As explained above, for example, conditions with a highest correction effect are selected when the target level cannot be attained, the conditions are compared with the target level when optimum conditions are set, it is desirable to provide means for notifying the outside of a state of the apparatus when the target cannot be attained, and it is desirable to also take into account the connecting portion of the upper end and the lower end of the head 7 in the evaluation.

Correction Processing (Gradation Correction)

Color unevenness correction is explained. Concerning the correction of color unevenness, for example, a section darker than a target only has to be lightened and a section lighter than the target only has to be darkened by changing a gradation value of image data of the section desired to be corrected.

As this processing, for example, it is desirable to perform multinarization processing after correcting gradation characteristics of an input and an output using a correction table at a stage of CMYK or RGB data before multinarization (four values of large droplets, medium droplets, small droplets, and no droplet) into dot ejection data of inkjet. The correction table is a table in which it is described which output levels are respectively set for input levels 0 to 255 of CMYK or RGB. The correction table is stored in the ROM 202 or the like in advance and applied. The correction table is prepared in advance for each correction segment.

As division of the correction segment, for example, at a stage of CYK or RGB data before multinarization of image data, the head 7 only has to be divided by the se number of divisions by set dividing points. Correction only has to be performed using the correction tables corresponding to the respective divided segments.

A target value of correction depends on how a target of image characteristics of the image forming apparatus is set. For example, it is conceivable to adjust the other sections to a dark section on the paper surface, adjust the other sections to a light section on the paper surface, adjust the entire section to an average on the paper surface, and adjust the entire section to a target value set in advance.

However, there is a limit in correction when gradation correction is applied in a darkening direction. Specifically, for example, when a gradation does not reach a target density regardless of the fact that a maximum amount of ink, which the head 7 can elect, is ejected, further correction cannot be performed. In this way, in the gradation correction, the gradation can be corrected to be light by reducing the gradation in a lightening direction and reducing an amount of ink to be elected. However, because the amount of ink cannot be increased to exceed solid in the darkening direction, in principle, the correction in the lightening direction is mainly performed.

Therefore, it is desirable to set a section of lightest solid as a target of solid, set characteristics obtained by connecting the paper surface and the solid target with desired gradation characteristics as target characteristics, and correct a gradation to be adjusted to the target characteristics.

Figure 25:
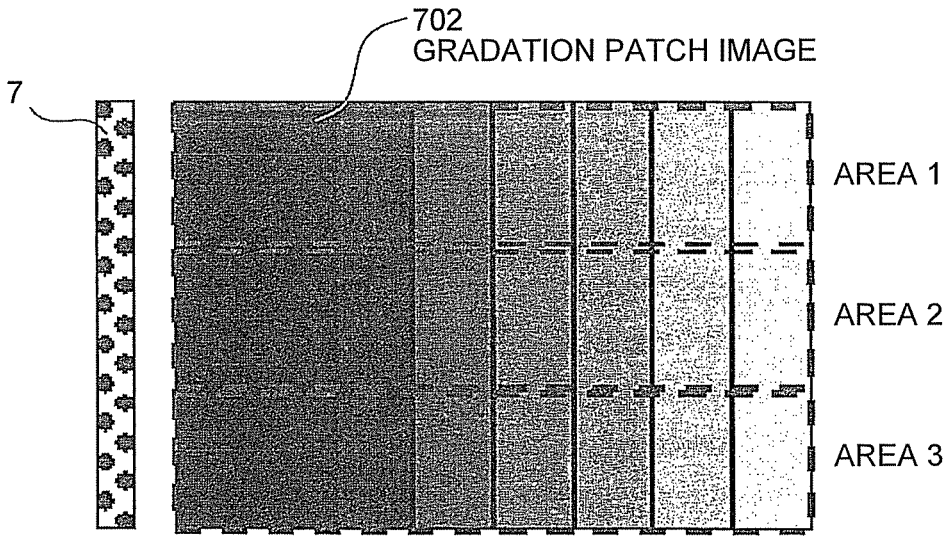
FIG. 25 is a schematic diagram of gradation patches output in gradation correction processing.

The processing is explained with reference to a schematic diagram of gradation patches output in the gradation correction processing shown in FIG. 25, a graph indicating a relation between gradation characteristics and target characteristics for each area shown in FIG. 26, and a flowchart of the gradation correction processing shown in FIG. 27. In the explanation, it is assumed that the number of divisions of the area and dividing points for the correction segments are already determined.

First, the image forming apparatus outputs a gradation patch image 702 for parameter creation and performs measurement (S701). In this processing, an image and brightness characteristic data output in the correction area division processing rather than during the start of the correction processing can be shared. Images and brightness characteristic data can be output and measured in respective kinds of the processing.

Concerning gradations, all the gradations can be printed and measured. However, it is also desirable to print and measure gradation values at intervals, create gradation characteristics by approximation, and reduce a processing amount necessary for the printing and the measurement. This is likely to locally cause gradation reversal of a characteristic value because of, for example, unevenness of the printing and the measurement. In this case, it is also likely that the gradations are reversely corrected. Therefore, this is also desirable because the influence of noise can be reduced.

The gradation characteristics are created for each correction segment. In actual correction, an average in segments is controlled. Therefore, the image forming apparatus creates gradation characteristics of an average of brightness characteristics in correction segments (S702).

Subsequently, the image forming apparatus finds a point with highest brightness in solid gradations of the entire area and sets the point as a brightness target of solid (S703). The image forming apparatus sets characteristics obtained by connecting the brightness on the paper surface and the solid brightness target with desired characteristics as gradation characteristics set as a target (target characteristics) (S704).

Figure 26:
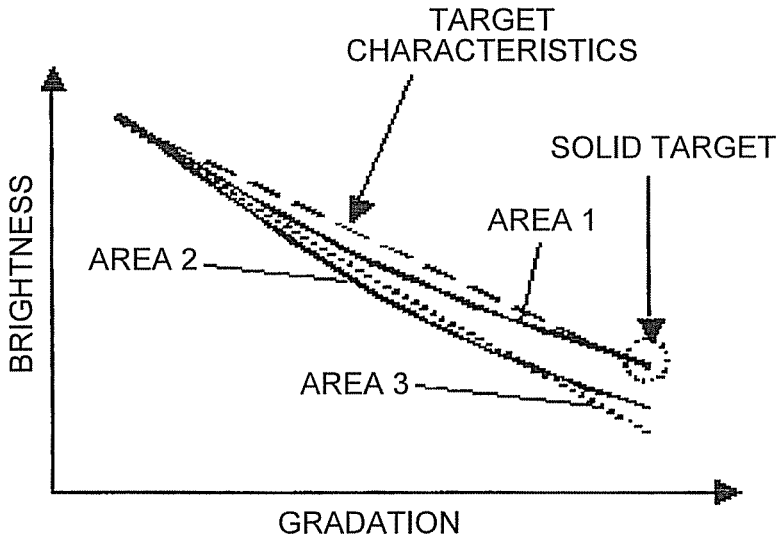
FIG. 26 is an example of a graph of a relation between gradation characteristics and target characteristics for each area.

In this embodiment, as shown in FIG. 26, solid brightness of an area 1 with highest brightness is set as a solid brightness target. The solid target brightness and paper surface brightness are connected with brightness linear (color burn) set as target characteristics to obtain target characteristics.

Subsequently, the image forming apparatus creates an input and output correction table for each area such that respective gradation characteristics match the target characteristics (S705). The correction table created in this way is stored in the ROM 202 or the like of the apparatus.

Finally, the image forming apparatus can correct the correction areas to the target gradation characteristics and reduce color unevenness in the paper surface by performing input and output correction using the correction table (S706).

Correction Processing (Driving Signal Correction)

Correction processing performed by changing a driving signal of the head 7 is explained. Correction of an input and an output can be performed by changing the driving signal. Specifically, concerning a section desired to be darkened, the driving signal is changed to increase an ink ejection amount. Concerning a section desired to be lightened, the driving signal is changed to reduce the ink ejection amount. For the correction of the driving signal, a driving waveform itself can be changed or an applied voltage can be changed to change a peak value.

Figure 27:
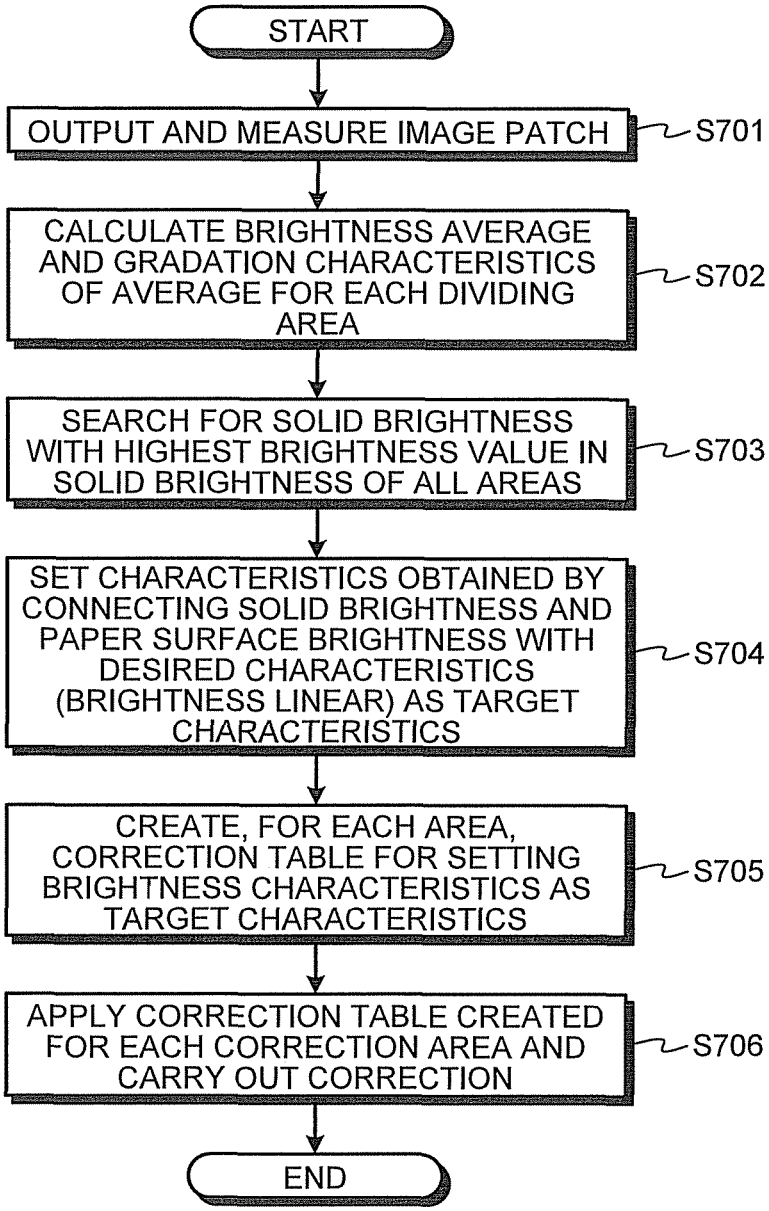
FIG. 27 is a flowchart for explaining an example of the gradation correction processing.

Concerning the correction processing by the driving signal correction, processing same as the processing of the flowchart shown in FIG. 27 only has to be performed. However, a degree of a change in brightness that occurs when the driving signal is changed is calculated in advance and set or patches obtained by multiplying together conditions of allotted driving signals and conditions of allotted gradation values are output and measured. This makes it possible to learn under which conditions areas and gradations should be driven when the driving signal is corrected to target characteristics. Therefore, the conditions only have to be stored in the ROM 202 or the like to perform the correction processing.

However, to implement a configuration for changing the driving conditions in a fine area in the head or changing the driving conditions for each gradation to be printed as explained above, it is likely that limitations in terms of hardware increases and the apparatus configuration is complicated. Therefore, it is more desirable to perform the gradation correction or a combination of the gradation correction and the driving signal correction.

Correction Processing (Gradation Correction and Driving Signal Correction)

Correction processing carried out by combining both of the gradation correction and the driving signal correction is explained.

The gradation correction can be carried out by changing correction parameters. Therefore, the gradation correction has an advantage that a unit of correction segment is easily set relatively finely and the correction is easily performed even if a characteristic change amount for each gradation is different. However, because the correction is performed by changing the number and the type of dots to be elected, the ink cannot be deposited exceeding solid. Therefore, basically, correction for increasing brightness is performed.

On the other hand, in the driving signal correction, an amount of ink to be ejected can be changed. Therefore, the driving signal correction has an advantage that it is possible to increase or reduce brightness in a range of stable driving of the head 7. However, for more finely division for the correction segments and switching of a signal for each gradation, the driving signal correction is limited in terms of hardware.

Therefore, correction processing is performed by combining both the gradation correction and the driving signal correction. Specifically, it is more desirable to perform the gradation correction after controlling a solid target with a driving signal.

For example, when a specific solid target value (brightness) is set in the image forming apparatus, the driving signal is adjusted within a stable ejection range such that solid of areas is set close to the solid target value. When a specific solid target value is not set, the driving signal is adjusted such than solid brightness is the lowest within the stable election range.

Consequently, the solid brightness itself can be set close to the target value. Therefore, it is possible to reduce a machine difference among apparatuses without complicating the configuration of the image forming apparatus and perform correction without narrowing a dynamic range of an output image.

The gradation correction is correction for changing a dot pattern arriving on the paper surface to set an ink coverage amount on the paper surface close to the dot pattern and reduce color unevenness. However, it is likely that a difference occurs in the dot arriving pattern on the paper surface among correction segments even if brightness is the same (i.e., an ink coverage amount in a micro level is the same) and the difference is observable. In particular, when it is attempted to absorb a large brightness change through the gradation correction, it is likely that such a problem becomes conspicuous.

On the other hand, when the correction processing is performed by combining both the gradation correction and the driving signal correction, it is possible to perform the gradation correction after setting the sizes of dots among the correction segments close to the dot pattern by the driving signal correction in advance. Therefore, the difference in the pattern less easily appears and a higher color unevenness correction effect can be obtained.

Before executing the correction area division processing and the correction processing, the image forming apparatus desirably execute a predetermined maintenance operation and processing for printing a nozzle check chart and confirming that no ejection failure occurs. This makes it possible to prevent an ejection failure or the like of the nozzles from affecting the correction.

In the correction area division processing, the image forming apparatus can output and measure a plurality of gradation patches and perform the processing explained above. However, the image forming apparatus can measure patches of a specific pattern to perform the determination explained above.

This is because, although a degree of variation of the characteristics in the head is different depending on a pattern to be output, a specific shape in the head is often caused by the structure of the head and it is highly likely that the number of divisions and the number of areas can be determined in a specific pattern. In other words, although the degree of variation is different in each head, a pattern of a change is often common in that a light section is also light and a dark section is also dark in other gradations. Therefore, a pattern in which characteristics of the head tends to vary (the intermediate pattern in which the paper surface is not completely filled with ink is often desirable) is prepared and the number of divisions and dividing points are determined from a measurement result concerning the pattern. This leads to a reduction in the number of output images and a measurement amount and makes it possible to further reduce a processing amount related to the correction.

Application Range of Correction Setting

An application range of correction setting is explained. As explained above, the heads 7 included in the image forming apparatus respectively have fluctuation in the characteristics thereof. In the same head 7, a difference in characteristics occurs according to differences in conditions such as a printing mode (e.g., resolution and a sheet) and temperature and humidity.

There are characteristics that, for example, a way of appearance of an influence on the paper surface is different depending on a color as well and a change in black is conspicuous and a change in yellow is less conspicuous even if a change in an ink coverage amount is the same.

It is desirable to apply the number of divisions and dividing points in the correction area division processing and correction conditions for segments in the correction processing according to each head 7, each printing mode, each temperature and humidity condition obtained by a temperature and humidity sensor provided in the image forming apparatus, and each color.

In particular, when resolution and a color are different, it is also desirable to change evaluation items and an evaluation formula for a correction result or change resolution and a measurement value for calculating profiles (e.g., black is determined according to brightness and yellow is determined according to saturation). Consequently, it is possible to perform correction corresponding to the heads 7 and printing conditions.

For setting of the application range of correction setting, the number of divisions, dividing points for the correction segments, and correction parameters of the correction segments for each condition only have to be stored in the ROM 202 or the like and invoked as appropriate according to conditions to perform correction.

The correction area division processing and the correction processing can be performed in a manufacturing process before product shipment. A reading unit such as a sensor, a scanner, or a colorimeter can be mounted on the image forming apparatus to perform patch reading and correction parameter creation after the shipment. In this case, an output unit (including the printing control unit 207) that prints gradation patches and the reading unit such as the sensor do not need to be always provided. When the patch reading and the correction parameter creation are performed after the shipment, time and labor required for creation of correction parameters are important. Therefore, the application of the present invention that can reduce a processing amount related to the correction processing is considered to be particularly suitable.

As explained above, with the image forming apparatus according to this embodiment, in the correction processing for a reduction in print, unevenness, it is possible to obtain a satisfactory correction effect while suppressing an increase in a processing amount related to the correction processing. For example, even when the number of divisions is set the same, it is possible to calculate dividing points for enabling most effective correction of color unevenness and perform effective correction. It is possible to reduce a processing amount related to the correction processing according to characteristics of the head 7 by changing any one of the set of dividing points and the number of divisions or both.

Second Embodiment

Another embodiment of the image forming apparatus according to the present invention is explained below. Explanation of the similarities to the embodiment explained above is omitted.

In recent years, image forming apparatuses are requested to be further increased in printing speed. However, production of a long head involves many problems. For example, technical difficulties such as the rigidity, the resonance, and the like of a frame are high, a probability of occurrence of defective nozzles rises because the number of nozzles increases, and yield decreases.

Figure 28A:
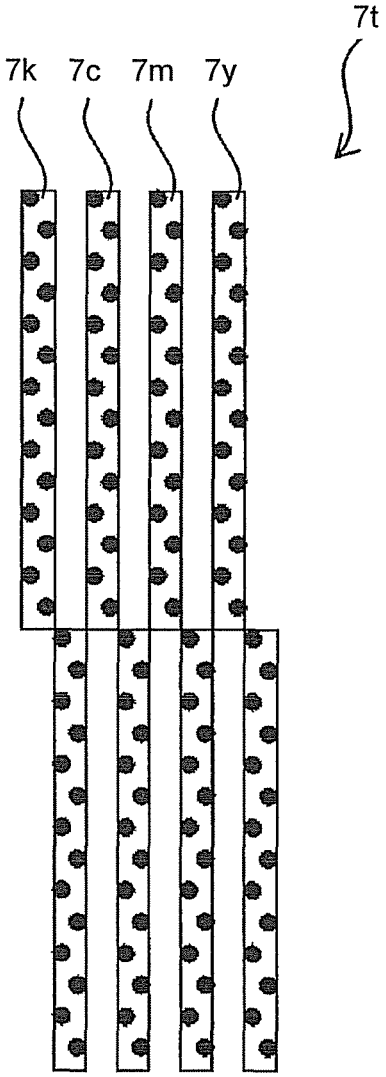
FIGS. 28A and 28B illustrate a connected head in which a plurality of heads are connected in a nozzle row direction.
Figure 28B:
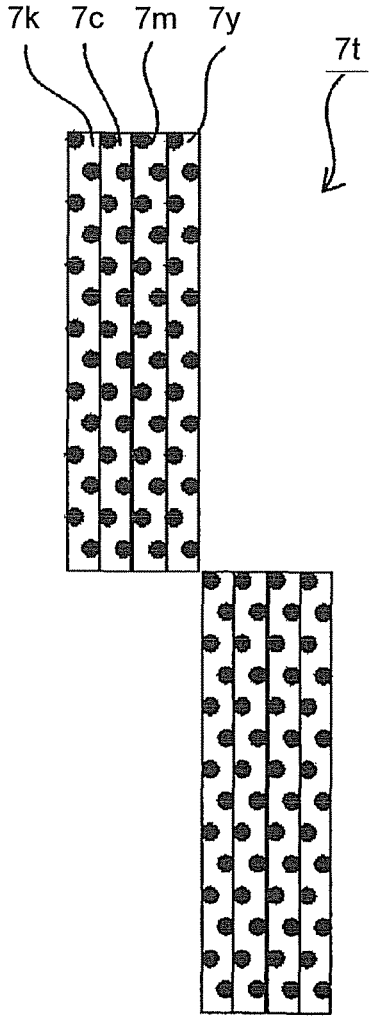

Therefore, an image forming apparatus of a serial system is known that includes a head (connected head 7*t*) obtained by connecting a plurality of recording heads 7 in a nozzle row direction as shown in FIGS. 28A and 28B and reciprocatingly moves the connected head 7*t* in a direction orthogonal to a sheet conveying direction to perform image formation.

Figure 29:
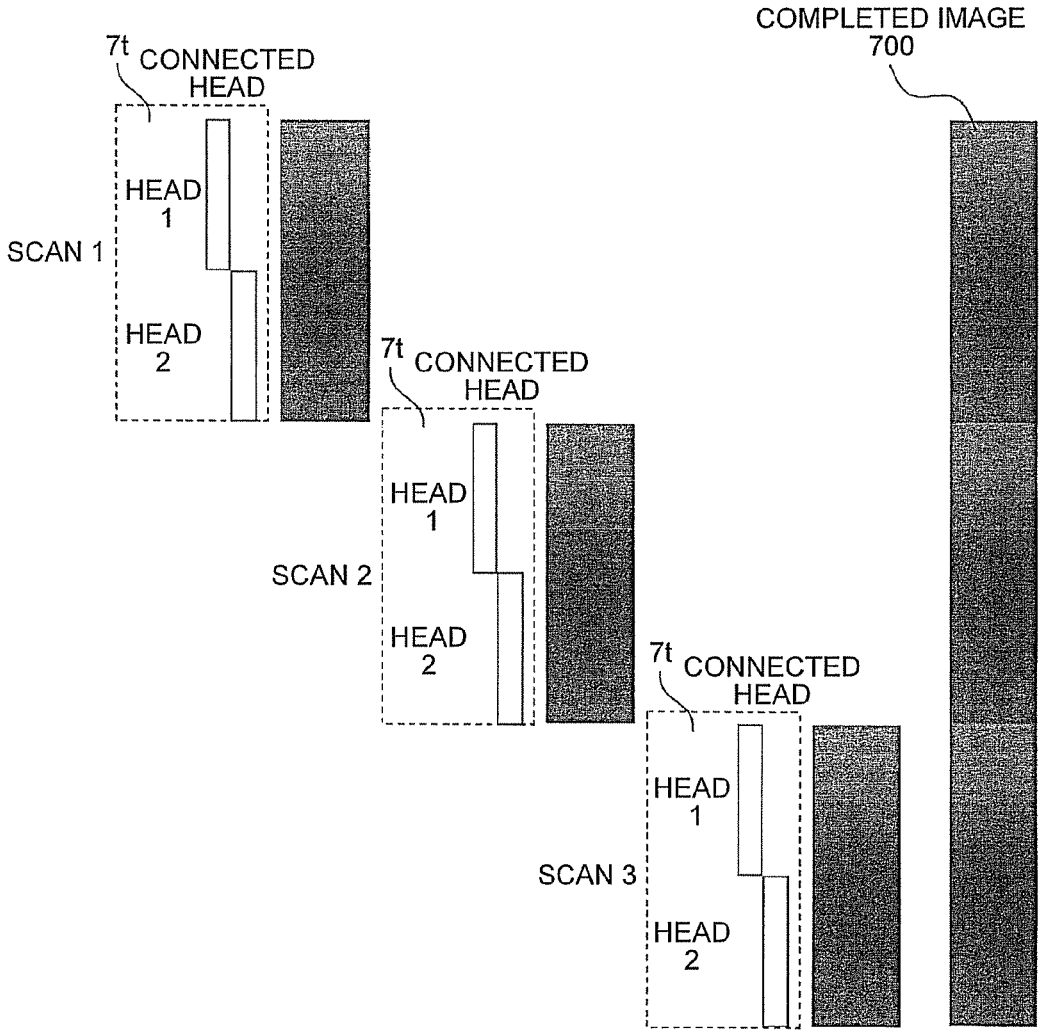
FIG. 29 is a diagram for explaining occurrence of color unevenness in the connected head.

In the connected head 7*t*, a basic configuration (four heads) is the same as that of the image forming apparatus explained in the first embodiment. However, in this embodiment, the image forming apparatus includes a plurality of heads 7 arranged in a longitudinal direction and performs an operation for starting a new line. Therefore, as shown in FIG. 29, both of a characteristic difference between the heads and a characteristic difference between scans (a difference between an upper end characteristic of an upper end head and a lower end characteristic of a lower end head) pose a problem. Further, the number of heads that should be corrected also increases. Therefore, it is possible to perform quick correction processing by applying the present invention to reduce a processing amount related to the correction processing.

In the connected head 7*t*, a characteristic difference caused in a changing portion of upper and lower heads and a changing portion of an upper end of the upper head and a lower end of the lower head also poses a problem. Therefore, when a correction effect is evaluated, it is desirable to evaluate the correction effect from characteristic profiles of length equal to or larger than connected head length taking into account these changing positions as well.

Figure 30:
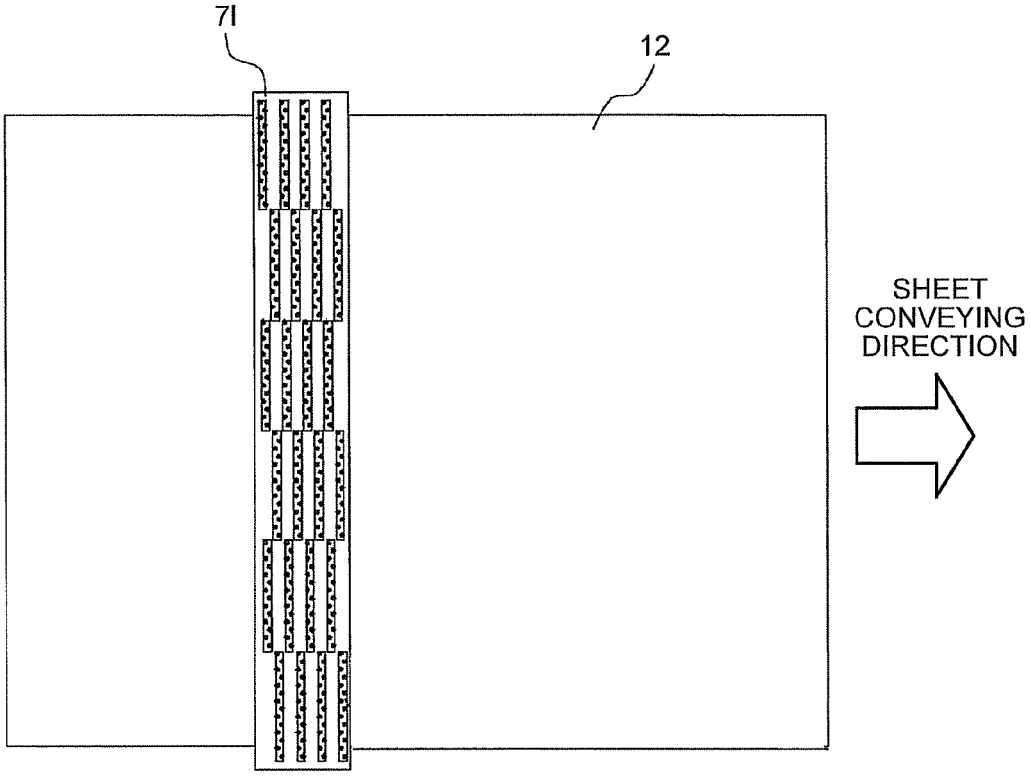
FIG. 30 is a diagram for explaining a line head in which a plurality of heads are connected in a nozzle row direction.

Concerning an image forming apparatus of a line system, the same effect can be obtained by performing the pr jut control explained above. FIG. 30 is a diagram of a stone of print by the image forming apparatus of the line system.

In the image forming apparatus, a line head unit 71 in which the recording heads 7 are connected is arranged over the sheet width of the sheet 12. The image forming apparatus conveys the sheet in a direction orthogonal to a nozzle row to perform image formation. In such an image forming apparatus of the line system, in principle, because the image formation is completed in one path (one sheet conveyance), although printing speed is extremely high, characteristic unevenness of the heads directly affects image quality. Therefore, it is particularly important to suppress fluctuation in image characteristics printed by the respective heads included in the line head unit 71.

In the image forming apparatus of the line system, the number of heads to be controlled substantially increases to several times to several tens times as large as the number of heads of a serial machine. The image forming apparatus of the line system is often used in an environment in which color proofreading is required such as the printing field. It is possible to reduce a correction processing amount for each one head and substantially reduce an overall processing amount by performing the correction processing explained above. Therefore, it is extremely effective to apply the correction processing. In the evaluation of a correction effect, as in the image forming apparatus including the connected head, it is desirable to perform the evaluation taking into account a characteristic difference in a boundary portion with an adjacent head as well.

As explained above, in the image forming apparatus including the connected head in which a plurality of heads are connected and the image forming apparatus of the line system, it is also possible to obtain a satisfactory correction effect while suppressing an increase in a processing amount related to the correction processing. Therefore, it is possible to realize an inkjet recording apparatus in which occurrence of color unevenness is suppressed and obtain a satisfactory record without color unevenness.

The correction area division processing and the correction processing can be executed by either the image processing apparatus 400 (the image processing apparatus 400 includes the correcting unit 240) connected to the image forming apparatus or the correcting unit 240 of the image forming apparatus. Among multifunction peripherals in recent years, there are many apparatuses that carry out scanning and printing processing not via a host computer. Therefore, if an image forming apparatus alone is configured to be capable of carrying out the correction processing, it is possible to provide an image forming apparatus adapted to extensive needs of use. In general, the CPU 201 and the like of the image forming apparatus have a low processing ability compared with the image processing apparatus 400. Therefore, it is possible to perform quick correction processing by applying the present invention to reduce a processing amount related to the correction processing.

According to the embodiments, in the correction processing for a reduction in print unevenness, it is possible to obtain a satisfactory correction effect while suppressing an increase in a processing amount related to the correction processing.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a recording head including a plurality of nozzles for ejecting recording liquid to perform image formation on a recording medium; and a correcting unit configured to divide the recording head by different division patterns each indicating that the recording head is divided into a plurality of segments by at least one different dividing point, correct input and output characteristics for each of the segments in each division pattern to calculate correction effect of the each division pattern, and determine one of the division patterns based on the calculated correction effects of the division patterns as a specified division pattern to correct input and output characteristics of the recording head.

2. The image forming apparatus according to claim 1, wherein the correcting unit determines the division pattern corresponding to a highest correction effect among the calculated correction effects of the division patterns as the specified division pattern.

3. The image forming apparatus according to claim 1, wherein the division patterns include a division pattern indicating that the recording head is divided into a plurality of segments by a different number of divisions.

4. The image forming apparatus according to claim 3, wherein the correcting unit calculates the correction effects of the division patterns corresponding to the respective numbers of divisions in order from a smallest number of divisions.

5. The image forming apparatus according to claim 1, wherein, when the calculated correction effect satisfies a predetermined condition, the correcting unit determines the division pattern corresponding to the calculated correction effect satisfying the predetermined condition as the specified division pattern.

6. The image forming apparatus according to claim 1, wherein the correcting unit evaluates the correction effects based on image characteristic information including any one of brightness, density, saturation, and luminance or a combination thereof.

7. The image forming apparatus according to claim 6, further comprising:

an output unit configured to print and output an image patch; and a reading unit configured to read the image patch, wherein the image characteristic information is acquired by the reading unit.

8. The image forming apparatus according to claim 6, wherein the correcting unit evaluates the correction effects based on at least one of variance, fluctuation width, a sum using an average, a root mean square, and differential information of the image characteristic information after correction.

9. The image forming apparatus according to claim 1, wherein the correcting unit corrects the input and output characteristics for each of the segments in each division pattern by at least one of gradation correction in which a gradation value of image data is changed and driving-signal correction in which driving signals for the nozzles included in the each segment are changed.

10. The image forming apparatus according to claim 1, wherein the image forming apparatus changes at least one of the correction of the input and output characteristics, the dividing point, and a number of divisions for the correction according to a printing mode of the image forming apparatus.

11. The image forming apparatus according to claim 1, further comprising a temperature and humidity sensor configured to detect a temperature and humidity environment of the image forming apparatus, wherein the image forming apparatus changes at least one of the correction of the input and output characteristics, the dividing point, and a number of divisions according to a result of the detection by the temperature and humidity sensor.

12. An image correcting method comprising:

dividing a recording head by different division patterns each indicating that the recording head is divided into a plurality of segments by at least one different dividing point, the recording head including a plurality of nozzles for electing recording liquid to perform image formation on a recording medium;

correcting input and output characteristics for each of the segments in each division pattern to calculate correction effect of the each division pattern; and determining one of the division patterns based on the calculated correction effects of the division patterns as a specified division pattern to correct input and output characteristics of the recording head.

13. A non-transitory computer-readable storage medium with an executable program stored thereon, wherein the program instructs a processor of an image forming apparatus to perform:

dividing a recording head included in the image forming apparatus by different division patterns each indicating that the recording head is divided into a plurality of segments by at least one different dividing point, the recording head including a plurality of nozzles for ejecting recording liquid to perform image formation on a recording medium;

correcting input and output characteristics for each of the segments in each division pattern to calculate correction effect of the each division pattern; and determining one of the division patterns based on the calculated correction effects of the division patterns as a specified division pattern to correct input and output characteristics of the recording head.

14. The non-transitory computer-readable storage medium according to claim 13, wherein the division patterns include a division pattern indicating that the recording head is divided into a plurality of segments by a different number of divisions.

* * * * *